US007841246B2

(12) United States Patent
Swanson et al.

(10) Patent No.: US 7,841,246 B2
(45) Date of Patent: Nov. 30, 2010

(54) CABLE LENGTH MEASURING DEVICE

(75) Inventors: David W. Swanson, Fallbrook, CA (US); William Robert Swanson, Fallbrook, CA (US)

(73) Assignee: Delta II, I.P., Stockton, CA (US)

( * ) Notice: Subject to any disclaimer, the term of this patent is extended or adjusted under 35 U.S.C. 154(b) by 258 days.

(21) Appl. No.: 12/287,657

(22) Filed: Oct. 10, 2008

(65) Prior Publication Data

US 2010/0089175 A1 Apr. 15, 2010

(51) Int. Cl.
*G01L 5/04* (2006.01)
*G01B 3/10* (2006.01)

(52) U.S. Cl. ..... 73/862.44; 33/756

(58) Field of Classification Search ..... 73/862.44
See application file for complete search history.

(56) References Cited

U.S. PATENT DOCUMENTS 5,302,161 A * 4/1994 Loubert et al. ..... 482/8
5,324,909 A * 6/1994 Derighetti ..... 219/69.12
5,365,797 A * 11/1994 McCrory, III ..... 73/862.44
6,491,773 B1 * 12/2002 Miller et al. ..... 156/64
6,901,818 B1 * 6/2005 Cheung ..... 73/862.393

* cited by examiner

*Primary Examiner*—Lisa M Caputo
*Assistant Examiner*—Octavia Davis
(74) *Attorney, Agent, or Firm*—Palomar Patent; Calif Tervo

(57) ABSTRACT

A device for measuring the length of a cable under tension moved through the device generally comprises a frame, a measuring pulley rotatably mounted on the frame; an anti-slip device for rollingly holding the midsection of the cable in a non-slipping manner against the measuring pulley such that movement of the cable rotates the measuring pulley, and a rotation sensor for sensing the rotation of the measuring pulley and producing a signal indicative of the rotation thereof. The anti-slip device generally comprises one or more loading rollers and a loading assembly including a flexible tension member for applying loading to the loading rollers such that movement of the cable rotates the measuring pulley. A location measuring device incorporating the cable length measuring device determines the direction and distance from the location measuring device to a free end of the cable.

12 Claims, 17 Drawing Sheets

CABLE LENGTH MEASURING DEVICE

FIELD OF THE INVENTION

This invention relates in general to a cable length measuring device and more specifically involves a cable length measuring device having an anti-slip device for preventing the cable from slipping on a measuring pulley.

SUMMARY OF THE INVENTION

The invention is a measuring device for measuring the length of a cable under tension moved through the measuring device. The device generally comprises a frame, a measuring pulley rotatably mounted on the frame; an anti-slip device for rollingly holding the midsection of the cable in a non-slipping manner against the measuring pulley such that movement of the cable rotates the measuring pulley, and a rotation sensor.

The measuring pulley is mounted on the frame so as to rotate in a measuring pulley plane about an axis. The measuring pulley has a circumferential surface including a cable receiving portion for receiving the cable. The rotation sensor is connected to the frame and senses the rotation of the measuring pulley and produces a signal indicative of the rotation thereof.

The anti-slip device generally comprises one or more loading rollers and a loading assembly. Each loading roller comprises a loading roller shaft mounted on the frame so as to be displaceable relative to the measuring pulley, and a loading roller disk mounted on the loading roller shaft so as to rotate in the measuring pulley plane. The loading assembly includes a tension member flexible in the measuring pulley plane including a first end connected to the frame, a second end connected to the frame, and a midsection connected to the loading roller shaft for applying loading to the loading rollers as a function of the tension of the tension member for pressing the loading roller disks against the cable on the cable receiving portion of the circumferential surface of the measuring pulley such that movement of the cable rotates the measuring pulley.

A tension adjusting means connected to the frame and to the tension member adjusts the tension in the tension member. The tension member may be a band such that the midsection of the tension member supports the loading roller shaft on the frame.

A location measuring device incorporating the cable length measuring device comprises a base unit including a frame, a main datum passage attached to the frame for confined passage of the midsection of the cable, means for determining the direction of the cable from the main datum passage to a free end of the cable; and the cable length measuring device measuring the length of the cable moved through the measuring device.

Other features and many attendant advantages of the invention will become more apparent upon reading the following detailed description together with the drawings wherein like reference numerals refer to like parts throughout.

DETAILED DESCRIPTION OF THE INVENTION

FIGS. 1-13 illustrate a location measuring device 10 incorporating the cable length measuring device 450 of the invention.

FIGS. 14-21 describe in greater detail the cable length measuring device 450 of the invention.

Figure 3:
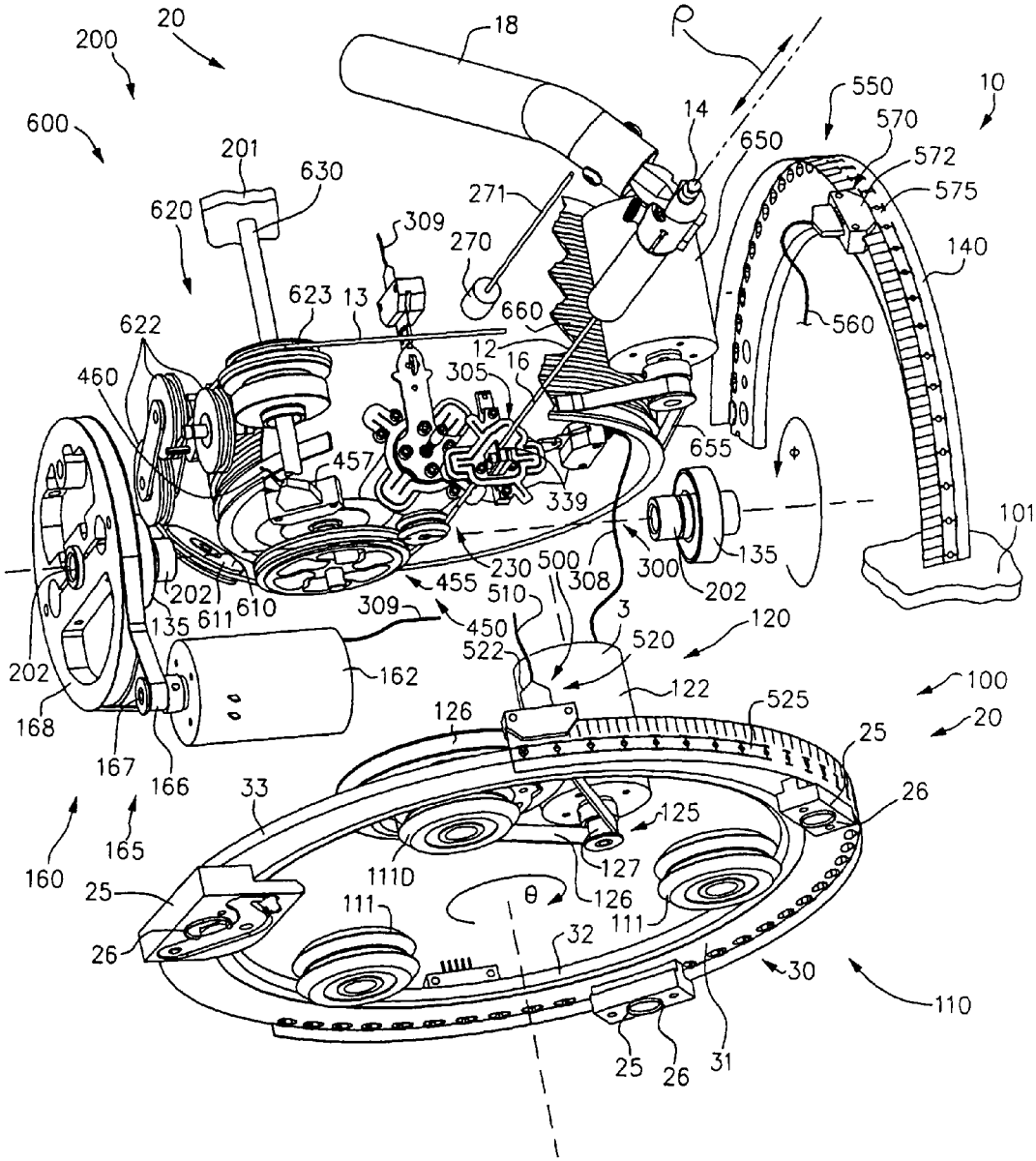
FIG. 3 is a bottom, front, left side, partially cut away, perspective view of selective elements of FIG. 2.
Figure 14:
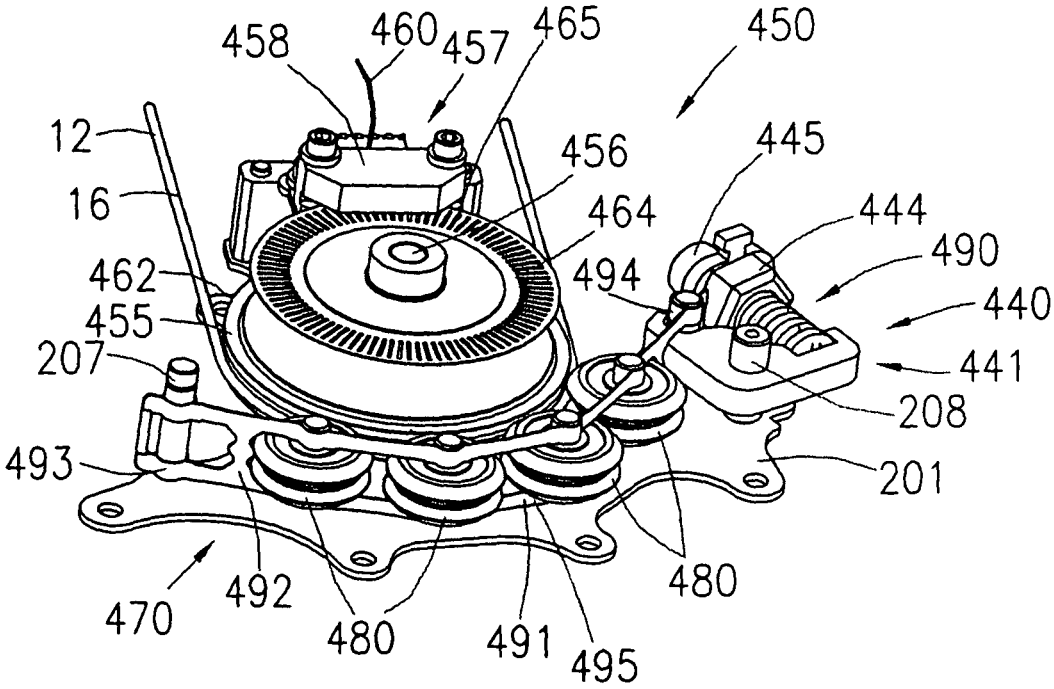
FIG. 14 is an enlarged perspective view of the cable length measuring device of FIG. 3 including a cable anti-slip device.
Figure 15:
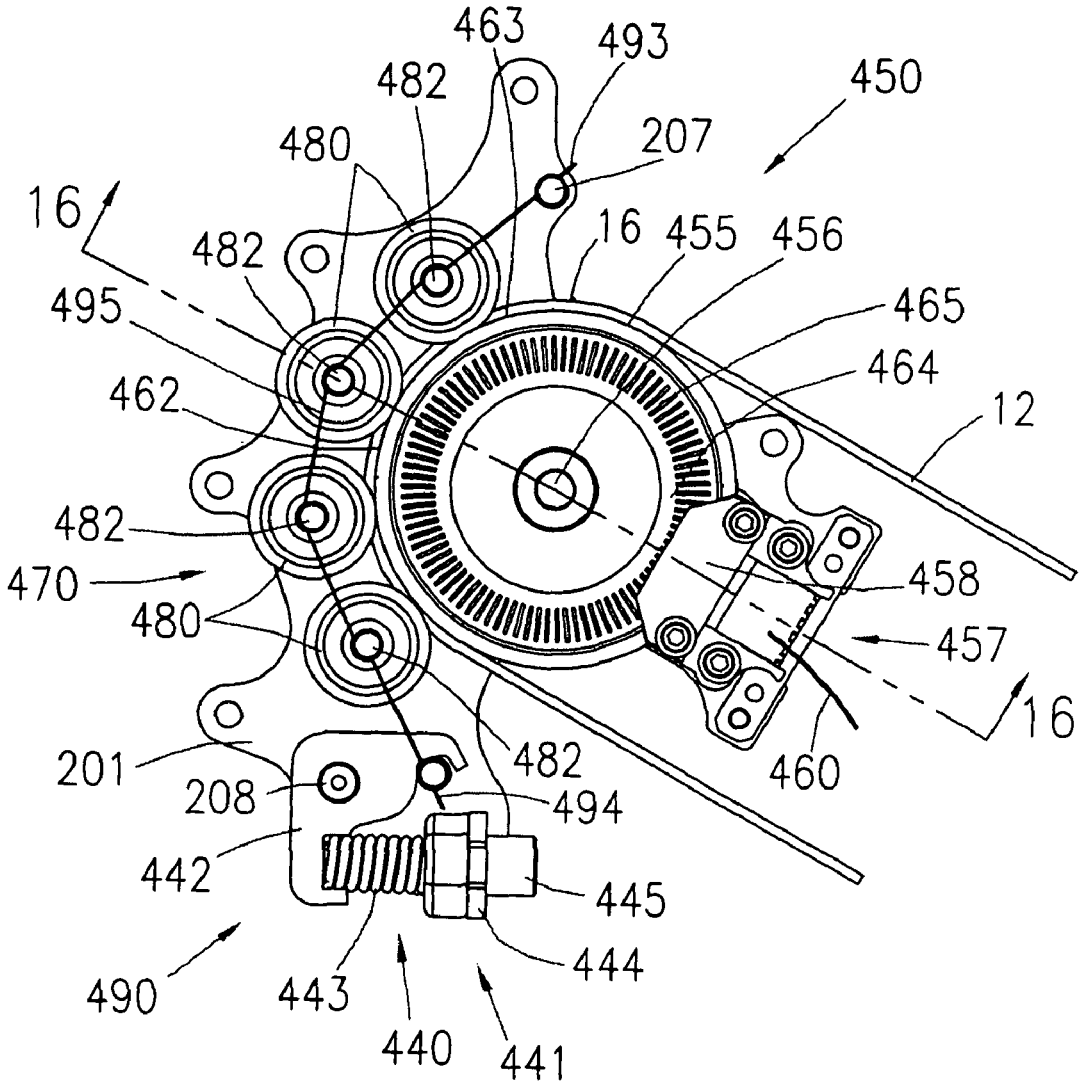
FIG. 15 is a top elevation view of the cable length measuring device of FIG. 14.
Figure 16:
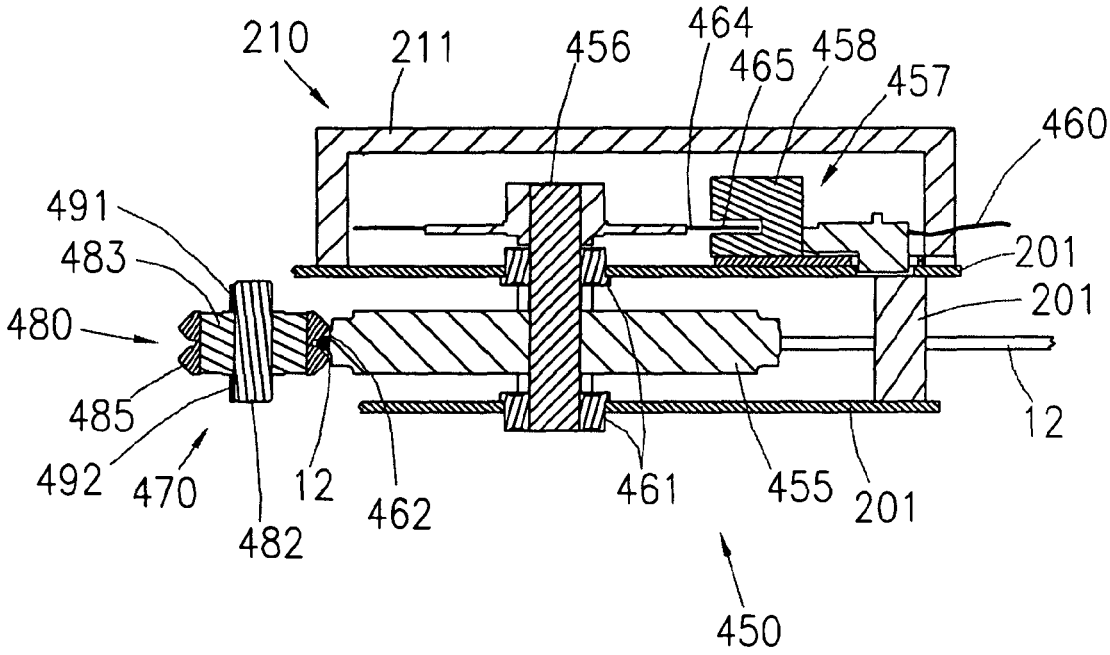
FIG. 16 is a sectional view of the cable length measuring device taken on line 16-16 of FIG. 15 and further including a cover for a rotation sensor.
Figure 17:
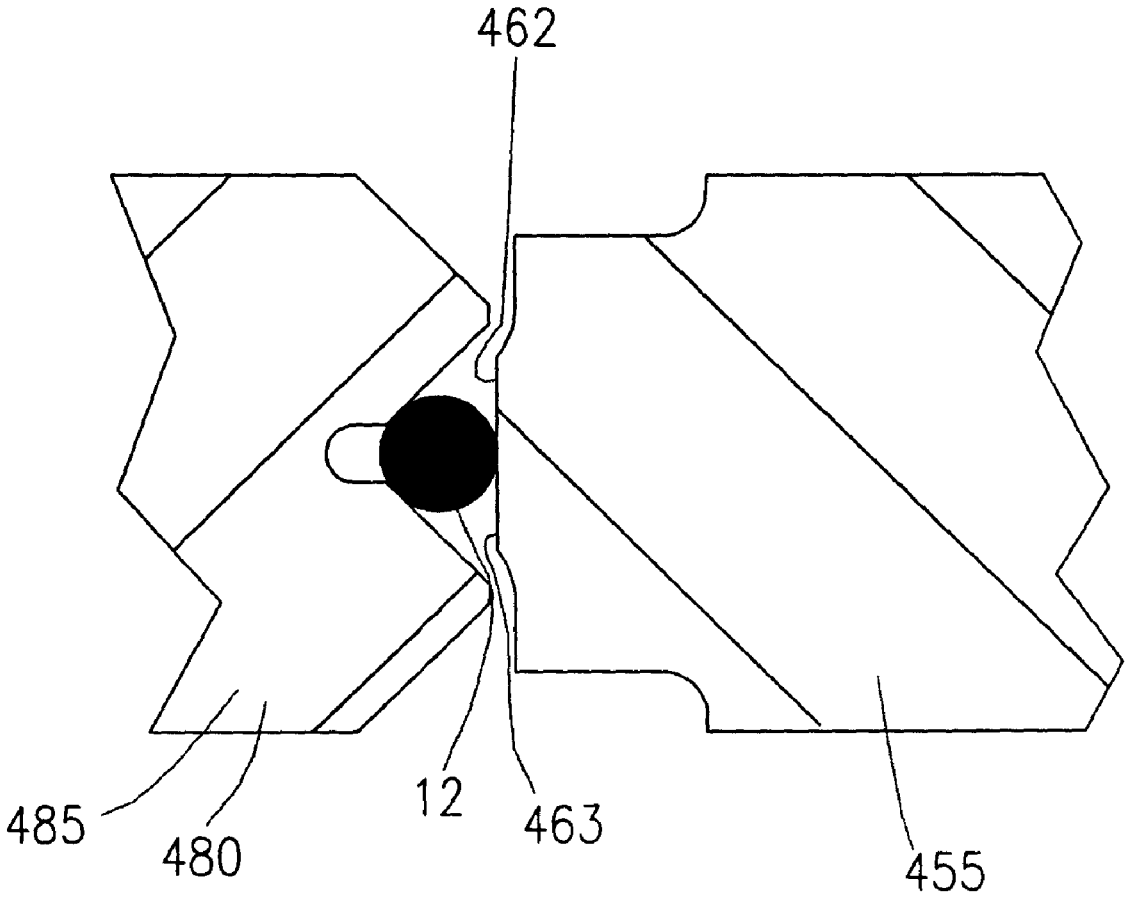
FIG. 17 is an enlarged, partial view of the interface between the cable, the measuring pulley, and a loading roller.

Looking first at FIGS. 14-17, there is shown in FIG. 14 an enlarged perspective view of cable length measuring device 450 of FIG. 3 including a cable anti-slip device 470, in FIG. 15 a top elevation view of cable length measuring device 450 of FIG. 14, in FIG. 16 a sectional view of cable length measuring device 450 taken on line 16-16 of FIG. 15 and further including a cover 211 for a rotation sensor 457, and in FIG. 17 an enlarged, partial view of the interface between cable 12, measuring pulley 455, and a loading roller 480.

Cable length measuring means 450 is attached to frame 201 and is coupled to cable 12 for measuring the length ρ (rho) or change of length of midsection 16 of cable 12 as free end 14 is moved and placed on a point. Cable length measuring means 450 generally includes a measuring pulley 455 mounted on second carriage frame 201, a rotation sensor 457, and an anti-slip device 470.

Measuring pulley 455 includes an axle 456 rotatably mounted, such as by bearings 461, on second carriage frame 201 such that measuring pulley 455 rotates in a measuring pulley plane about the axis of axle 456. Measuring pulley 455 has a precision circumferential surface 462 for receiving midsection 16 of cable 12. Preferably, midsection 16 of cable 12 is partially wrapped around measuring pulley 455 to define a cable receiving portion 463 to increase surface friction such that movement of cable 12 rotates pulley 455. In the embodiment of FIG. 15, cable receiving portion 463 includes one-half the length of surface 462.

Anti-slip device 470 helps prevent midsection 16 of cable 12 from slipping on circumferential surface 462 of the measuring pulley 455 such that an accurate reading of cable movement is obtained. Anti-slip device 470 generally comprises a plurality of loading rollers 480, and roller loading assembly 490. Each loading roller 480 includes a loading roller shaft 482 and a loading roller disk 485 mounted on loading roller shaft 482, such as with bearings 483, so as to rotate in the measuring pulley plane. Loading roller shaft 482 is ultimately supported by frame 201 so as to be displaceable relative to measuring pulley 455

Figure 18:
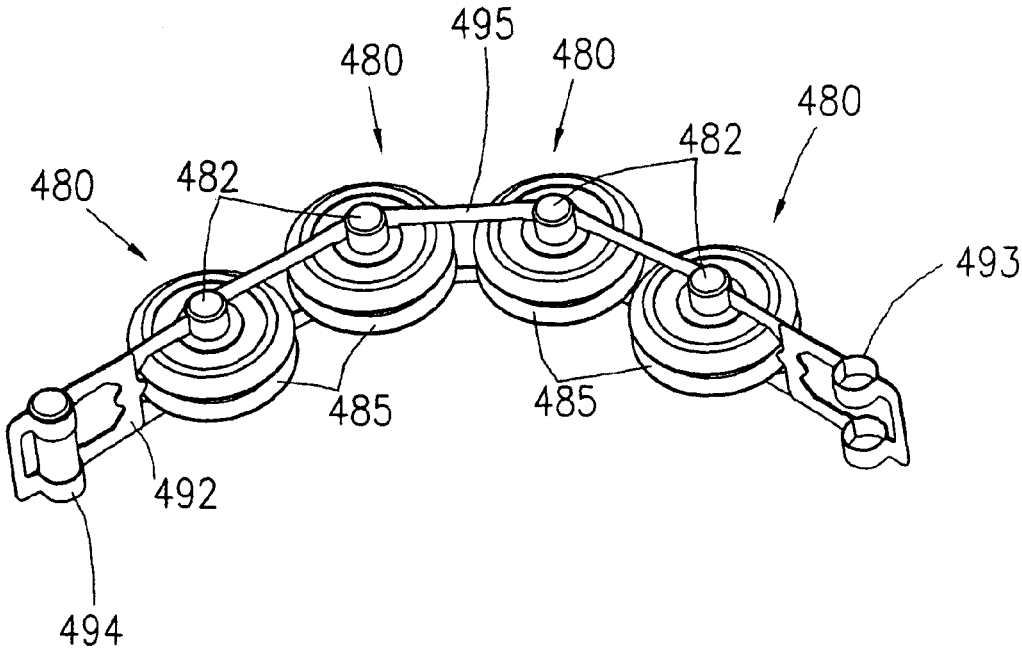
FIG. 18 is an enlarged perspective view of the flexible tension band.

Roller loading assembly 490 generally includes a flexible tension member 491, such as tension band 492, and tension adjusting means 440, such as adjustment assembly 441, for adjusting the tension in tension member 491. FIG. 18 is an enlarged perspective view of flexible tension band 492 supporting loading rollers 480 Tension band 492 is flexible in the measuring pulley plane and is not flexible in the perpendicular plane and includes a first end 493 connected to frame 201, such as to post 207, a second end 494 connected to ultimately to frame 201 such as through tension adjustment assembly 441, and a midsection 495 connected to loading roller shafts 482 for applying loading to loading rollers 480 as a function of the tension of tension member 491 for pressing loading roller disks 485 in rolling contact with cable 12 against cable 12 on cable receiving portion 463 of circumferential surface 462 of measuring pulley 455 such that cable 12 is held in firm frictional engagement with measuring pulley and movement of cable 12 rotates measuring pulley 455. In the exemplary embodiment, tension member 491 is a tension band 492 that is connected to and supports the loading roller shafts 482 such that loading rollers are displaceable in the measuring pulley plane. Exemplary tension band 492 is a thin metal sheet, such as of 0.007" thick spring steel including upper and lower webs attached to shafts 482. Band 492 could be any similar band such a chain constructed similarly of a bicycle chain.

Tension adjusting assembly 441 is connected to frame 201 and to tension member 491 for adjusting the tension in tension member 491. In the exemplary embodiment, tension adjusting assembly includes a pivot plate 442 pivotly mounted on post 208 of frame 201. One end of pivot plate 442 engages second end 494 of band 492 for applying tension thereto. One end of a compression spring 443 applies a force to the other end of pivot plate 442 so as to supply the tension force. A nut 444 is attached to frame 201. Tension adjustment screw 445 is engaged with nut 444 and bears against the other end of spring 443. Turning screw 445 in nut 444 adjusts the compression of spring 443 and, hence, the tension in band 492.

The tension can be adjusted to the minimum to prevent slippage of cable 12 and Although a tension band 492 is shown and described, a more simple tension member, such as an elastic cord or the like, may be used in which case the shafts 482 of loading rollers could be supported, such as by mounting in slots in frame 201.

Cable length measuring device 450 produces a signal, such as on line 460, indicative of the length ρ (rho) or change of length of cable 12. A rotation sensor 457, as is well known in the art, such as an optical encoder 458 mounted on frame 201, translates amount of rotation of pulley 455 to change in cable length and produces a signal on line 460 indicative thereof.

Optical encoder 458 could read directly off an encoder strip on measuring pulley 455. However, measuring pulley 455 may be subjected to dirt brought in by cable 12. Therefore, in the exemplary embodiment, an encoder disk 462 having an encoder strip 465 is mounted to axle 456 to turn with measuring pulley 456. Optical encoder 458 and encoder disk 464 are enclosed in a housing 210 comprising cover 211 and frame 201. Housing 210 maintains rotation sensor 457 in a clean environment.

Figure 19:
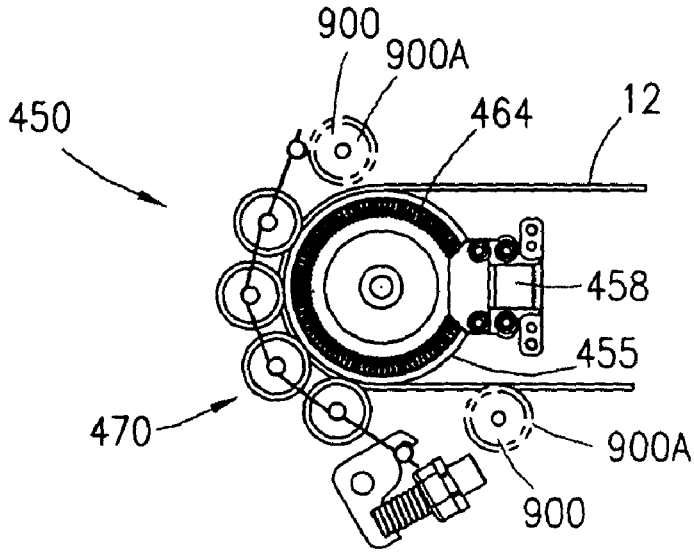
FIG. 19 is a top plan view of the cable length measuring device of FIG. 15 showing optional entry pulleys in phantom.

One or more entry pulleys 900, fixedly attached to frame 201 can be used to guide cable 12 into cable length measuring device 450 and assure that cable 12 does not lift roller disks 480. FIG. 19 is a top plan view of the cable length measuring device 450 of FIG. 15 showing optional entry pulleys 900, such as entry pulleys 900A shown in phantom. Cable 12 makes a substantially 180 degree turn through cable length measuring device 450.

Figure 20:
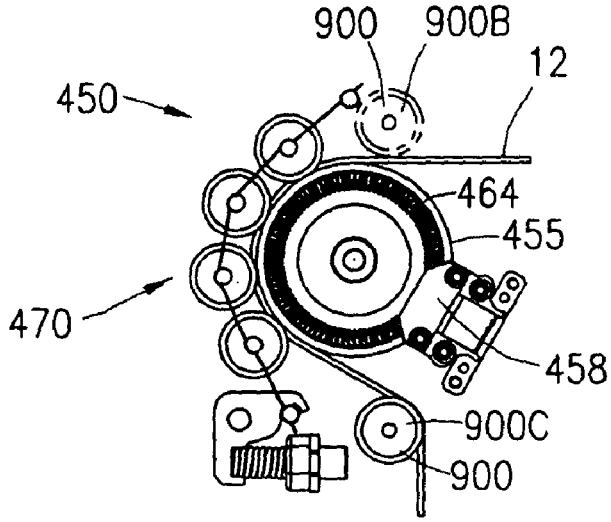
FIG. 20 is a top plan view of the cable length measuring device of FIG. 15 showing optional entry pulleys in phantom.

FIG. 20 is a top plan view of the cable length measuring device 450 of FIG. 15 showing an optional entry pulley 900B and showing a directional entry pulley 900C in phantom. Cable 12 exits cable length measuring device 450 90 degrees from entry. This configuration has many applications other than in location measuring device 10. For example, it could measure the linear movement of a lathe head by simply attaching one end of cable 12 to the lathe carriage and the other end to a weight or spring for providing cable tension.

Figure 21:
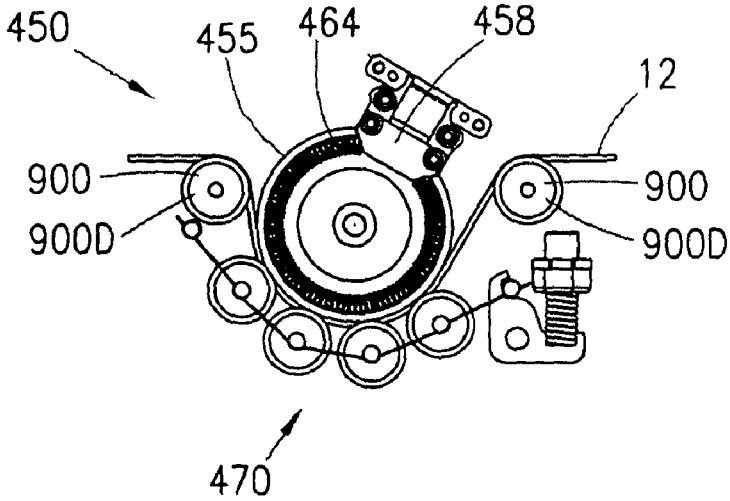
FIG. 21 is a top plan view of the cable length measuring device of FIG. 15 showing optional entry pulleys.

FIG. 21 is a top plan view of the cable length measuring device 450 of FIG. 15 showing optional directional entry pulleys 900D that guide cable 12 so that its entry and exit are linear.

Cable length measuring device 450 can receive cables of different diameter by adjusting the tension sufficiently for insertion of a new cable or by detaching one or both ends 493, 494 of tension member 480 from their restraint.

FIGS. 1-13 illustrate a location measuring device 10 incorporating the cable length measuring device 450 of the invention.

Figure 1:
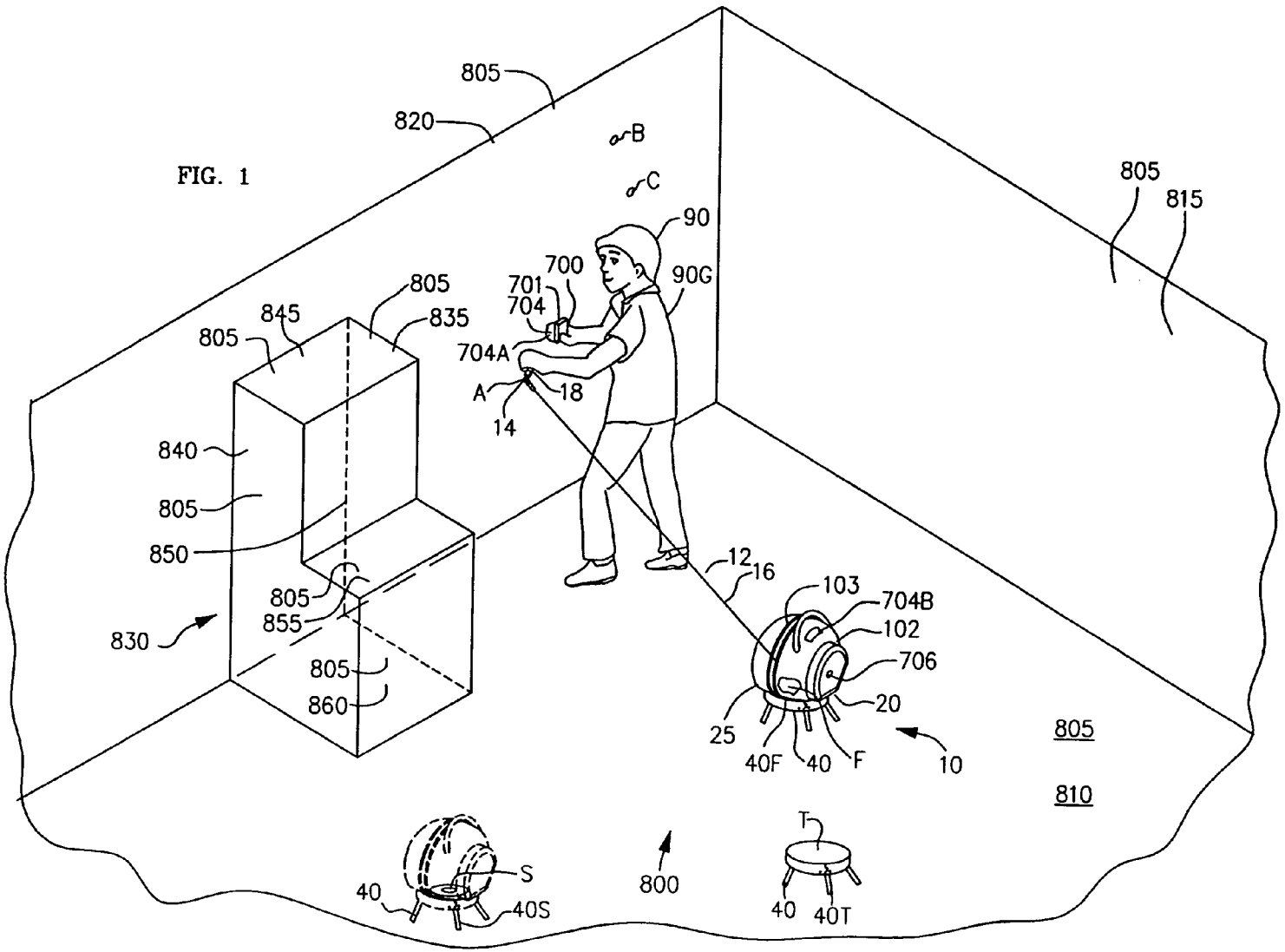
FIG. 1 is a perspective view of a room showing a use of the measuring device of the invention.

FIG. 1 is a perspective view of a room 800 showing a use of location measuring device 10. A user 90 uses location measuring device 10 to obtain numerical coordinates, such as polar coordinates, of a plurality of points in room 800. By measuring the location of a relatively small number of points in room 800, location measuring device 10 can define all of the desired surfaces 805 in three-space for purposes of determining the amount or size of flooring, paint, wall coverings, windows, counter tops, cabinets and other features.

Device 10 may be used in a factory to measure the three-dimensional location of piping, or machinery details, or other generally difficult-to-measure objects.

Surfaces 805 of room 800 include a floor 810, back wall 815, and side wall 820. A hutch 830 abuts side wall 820. Surfaces 805 of hutch 830 include a right side wall 835, a left side wall 840, a top surface 845, an upper front wall 850, a lower surface 855, and a lower front wall 860.

Device 10 generally includes a retractable cable 12 having a midsection 16 and an outer end, such as free end 14; a base unit 20 supporting devices for tracking movement of cable 12 and for measuring the length and direction of cable 12, a computer 700, such as a personal digital assistant (PDA) 701 held by a user 90, and a user interface 704 to computer 700 such as an entry pad 704A on PDA 701 or key pad 704B on base unit 20.

Housing 102 is protective against dirt and damage and defines an orifice 103 for passage of cable 12. As will be explained in greater detail later, housing 102 rotates to follow cable 12 as cable 12 is moved. Base unit 20 is adapted to be firmly supported by a surface. Framework 25 of base unit 20 is firmly supported by a support 40, such as a floor plate placed on the floor or, such as shown in the exemplary embodiment, on a first tripod 40F placed on floor 810. Preferably, base unit 20 is selectively attachable to support 40 for purposes as will be explained.

A user 90, such as grip user 90G, grips a grip 18 attached to cable free end 14 and places free end 14 on a point, such as point A on side wall 820, the location of which is to be measured by device 10. Grip 18 is attached to cable 12 in a manner so as to not introduce a moment to cable 12 so as to keep cable 12 linear. The distance to point A and the direction to point A are measured by measuring devices in housing 102.

One or more computers 700 are used for data input, storage, and processing. In the preferred embodiment shown, grip user 90G uses a hand held computer 700, such as a personal digital assistant (PDA) 701. PDA 701 contains a program adapted for receiving and processing data input. A computer program for performing the functions described herein is readily commercially available or can be written by a programmer reasonably skilled in the art or an existing program can be readily adapted to the specifics of device 10 by a programmer reasonably skilled in the art. Alternatively, a computer 700 may be located in base unit 20 or be a separate unit.

In the exemplary embodiment, grip user 90G enters input on entry pad 704A of PDA 701. PDA 701 and base unit 20 have wireless connectivity, such as radio, such as Bluetooth®, and PDA 701 receives the cable measurements from base unit 20. Other wireless connectivity, such as IrDA (infrared), sound, or Wi-Fi could be used. Alternatively, other input and connectivity methods could be used. A separate cable could be used. Input information could be transmitted via measuring cable 12. Data connectivity between computer 700, measuring devices, and grip user 90G allows just one person to be able to operate device 10 and measure room 800. A second user, not shown, could communicate with computer 700 in one of the above-described manners or furnish input via port 706 or on entry or key pad 704B on base unit 20.

Figure 13:
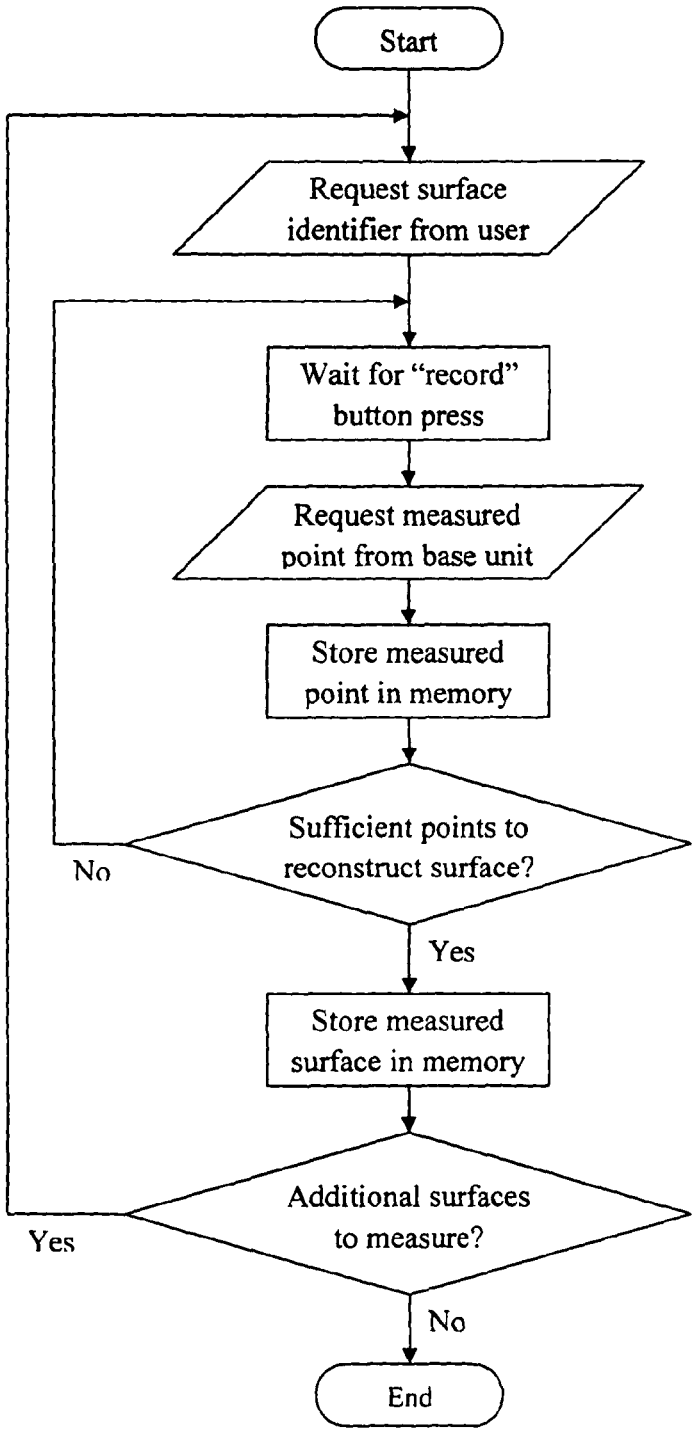
FIG. 13 is a flow chart for measuring a surface.

Turning momentarily to FIG. 13, there is shown a flow chart for taking measurement. A user inputs a surface identifier to identify the surface being measured for associating the measured points with. With cable free end 14 on a point to be measured on the surface, the user presses a "record" button. The measurements are recorded. If more points must be input to reconstruct the surface, then cable free end 14 is moved and additional points are recorded to memory for that surface. If not, then a new surface identifier is entered and points on that surface are measured.

In an exemplary use, user 90 places first tripod 40F firmly on floor 810 and attaches framework 25. The program in PDA 701 is activated for receiving data. Grip user 90G enters an identifier for a surface 805, such as side wall 820, to be measured. Grip user 90G enters an identifier for type of surface, for example "planar" for side wall surface 820, places cable free end 14 on a point, such as point A, on side wall 820, and presses a record button on PDA 701. The location of point A is determined by base unit 20 and is transmitted to PDA 701. This procedure is repeated with points B and C. PDA 701 now has in memory three points A, B, C that define a plane, of which side wall surface 820 is a part. The same procedure is used for other surfaces 805. Additional points on any surface 805 may be measured. The gathered data can be processed by computer 700 or sent, such as via port 706 or radio, such as with Bluetooth®, to another computer for processing.

From the measured data, imaging software, such as computer aided design (CAD) software reconstructs surfaces 820. Such software is well known in the art. An example is Geomagic Studio from Geomagic, Inc. Another software package for processing point data into three dimensions is RapidFormXOR from INUS Technology, Inc. and Rapidform, Inc.

Other identifiers for type of surface are used for more complex surfaces. For a surface identifier such as "smooth curve", the computer program could "fair" the associated measured points to arrive at the surface configuration. For each surface designation, one or more sub-designations may be used. For example, "edge" or "terminus" is used for designating an edge point or corner point on a surface respectively. For measuring more complex surfaces, a large number of points are measured or a "scan" sub-designation is entered and cable free end 14 is drawn along the surface and points are measured repeatedly If a surface 805 to be measured, such as hutch left end 840, cannot be measured by device 10 while mounted on first tripod 40F, such as because the surface 840 is not in the line of sight from first tripod 40F or cannot reached by cable end 14 from first tripod 40F, then an additional tripod, such as second tripod 40S, is placed in a suitable location for measuring surface 840. Each tripod 40 includes a reference point, such as point F, S or T, the location of which, relative to an attached base unit 20, is known. The location of reference point S on second tripod 40S is measured by device 10 to establish the spatial location of second tripod 40S relative to first tripod 40F. Base unit 20 is detached from first tripod 40F and attached to second tripod 40S. The reference point F on first tripod 40F is measured by base unit 20 on second tripod 40S to establish the angular orientation of base unit 20 on second tripod 40S relative to first tripod 40F. Points are measured from base unit 20 on second tripod 40S.

This tripod jumping pattern can be repeated to measure any surfaces 805. For example, to measure additional points that are not measurable from second tripod 40S, first tripod 40F, or another tripod 40T is moved to a suitable location for measuring the points. Its reference point F at the new location is measured, base unit 20 is detached from second tripod 40S and attached to the moved first tripod 40F, and reference point S of second tripod 40S is measured to establish the relative position of the new location.

If it is desirable to later add a surface 805 to the data or to later improve on or correct measured data from a surface 805, it is not necessary to re-input all of the measured points. Instead, to add a surface 805, base unit 20 is placed, as described above, in a position to both measure the additional surface 805 and to measure a plurality of points on already known surfaces 805. A "re-orientation" entry directs computer 700 to use the next measured points from known surfaces 805 to determine the location and orientation of base unit 20 by triangulation. The additional points or surface 805 can then be measured and added to the previously measured data.

Figure 2:
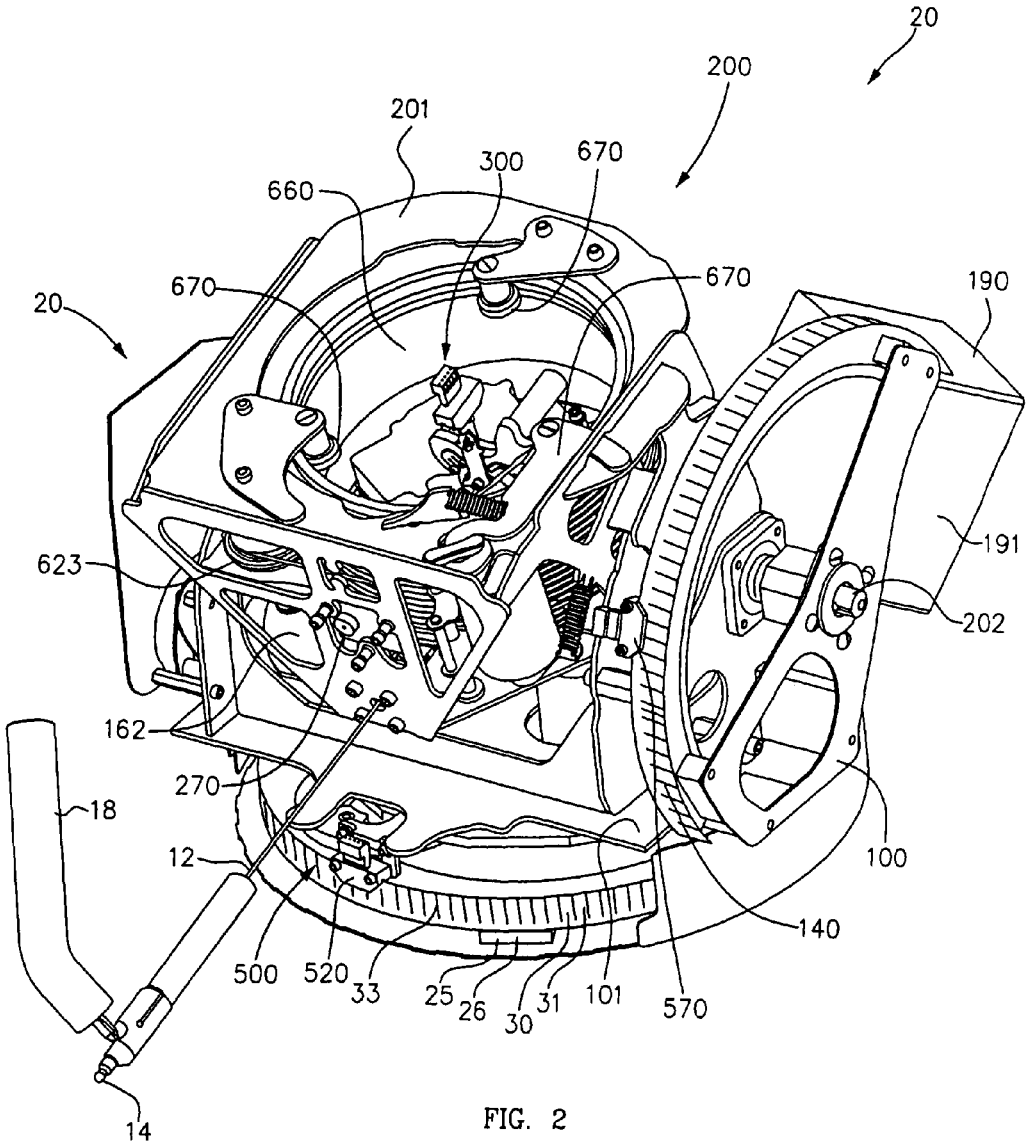
FIG. 2 is a top, front, right side, partially cut away, perspective view of selected elements of the base unit of the device.

FIG. 2 is a top, front, right side, partly cut away, perspective view of selected elements of the base unit 20 of device 10. FIG. 3 is a bottom, front, left side, perspective view of selected elements of FIG. 2. FIGS. 2 and 3 will be used to explain the overall functions of device 10. Pertinent elements will be later discussed in greater detail. A cable 12 includes a free end 14, a supply end 13, and a midsection 16 therebetween. Free end 14 is for placement on a point, the location of which is to be measured, such as point A on FIG. 1. A grip 18 attached to free end 14 of cable 12 is used, such as by gripping by user 90G, for positioning free end 14 at a point to be measured.

Base Unit 20 generally includes framework 25 for attachment to floor support 40, a base 30 attached to framework 25, a turn carriage 100 rotationally mounted on base 30, and a pitch carriage 200 rotationally mounted on turn carriage 100.

Framework 25 includes means, such as a plurality of cooperative connectors 26 for cooperating with support 40 for selectively attaching framework 25 to support 40.

Base 30 includes a ring 31 attached to and supported by framework 25. Ring 31 has a circular inner face 32 and a circular outer face 33.

Turn carriage 100 includes a plurality of components attached to a turn-carriage frame 101. In FIG. 3, frame 101 is only partially shown for clarity. Turn carriage 100 includes means 110, such as a plurality of wheels 111, for rotationally mounting turn carriage 100 on base 30. Wheels 111 including drive wheel 111D, are mounted on frame 101 and rotationally mount turn carriage 100 on inner face 32 of ring 31 of base 30. Turn carriage 100 is rotationally attached to base 30 so as to be rotatable about a yaw axis, such as first axis or turn axis θ (theta). Turn axis θ is typically perpendicular to the floor or other support 40 for base unit 20. Thus, turn axis θ typically is vertical or substantially vertical. Turn carriage 100 can rotate left or right and any number of degrees to align cable 12 in any direction.

Base unit 20 includes power means 190, such as a battery 191 for powering components. Battery 191 is attached to base unit 20, such as to turn-carriage frame 101. Power is distributed from battery 191 to the components by any desirable means, such as power lines, not shown.

Pitch-carriage mounting means, such as a pair of spaced bearings 135 are attached to frame 101 for rotational mounting of pitch carriage 200.

Pitch carriage 200 includes a plurality of components attached to pitch-carriage frame 201. In FIG. 3, frame 201 is only partially shown for clarity. Pitch carriage 200 is rotationally attached to turn carriage 100, such as by shafts 202 attached to frame 201 and journaled in bearings 135, so as to be rotatable about a second or pitch axis ϕ (phi) defined by bearings 135. In the exemplary embodiment, pitch carriage 200 may pitch down at an angle of about 35° and rotate upward from there through an angle of about 92° for 127° total motion.

A main datum passage 230 is attached to frame 201 and provides a confined passage for midsection 16 of cable 12. In the preferred embodiment shown, second axis ϕ is perpendicular to and intersects turn axis θ. Main datum passage 230 is located at, or near, this intersection. Consequently, the relative polar coordinates ρ, θ, ϕ of cable end 14 may be rather straightforwardly produced from main datum passage 230. However, other relative axes may be used and the measurements to the point may then be mathematically transformed as is well known in the art, into any desired coordinate system.

A cable supply means 600 is attached to frame 201 and supplies cable 12 from supply end 13 under a predetermined tension to main datum passage 230. In the exemplary embodiment, cable supply means 600 includes a drum or reel 660, upon which cable 12 is wound, a cable tension sensor 610 for sensing the tension in cable 12 supplied to main datum passage 230, and a reel servoed motor 650 coupled to reel 660 such as by belt 655 for rotating reel 660. Reel mounting means, such as a plurality of rollers 670, is mounted to pitch frame 201 for supporting reel 660 such that it may rotate for storage or release of cable 12. Sensors for determining the tension in cable are well-known in the art. In the exemplary embodiment, cable tension sensor 610 includes a sensor and a roller pulley 611. Roller pulley 611 is rotatably mounted to pitch carriage frame 201 and is spring biased to push against cable 12 between other cable supports and rotate with cable movement. Sensor 610 senses the location of pulley 611 and produces a signal representative thereof. Responsive to the signal from tension sensor 610, reel servoed motor 650 rotates reel 660 to maintain the predetermined tension in cable 12.

Other cable tension sensing means well-known in the art could be used, such as a load cell to measure load on pulley 611.

Cable positioning means 620; attached to frame 201, includes a plurality of pulleys 622 feeding cable 12 to, or receiving cable 12 from, a final positioning pulley 623. Final positioning pulley 623 is mounted on a shaft 630 attached to frame 201 so as to slide axially along shaft 630 and feed cable 12 to reel 660 such that cable 12 does not overlap on reel 660.

Cable length measuring device of the invention 450, only partially shown, produces a signal, such as on line 460, indicative of the length ρ (rho) or change of length of cable 12. A rotation sensor 457, as is well known in the art, such as an optical encoder 458 mounted on frame 201, translates amount of rotation of pulley 455 to change in cable length and produces a signal on line 460 indicative thereof.

Pitch carriage 200 includes an angular displacement sensor 300 attached to frame 201 and located between datum passage 230 and cable free end 14 and defining an alignment position 305 wherein the local longitudinal axis of cable 12 is aligned with datum passage 230. As cable free end 14 is moved from an old point to a new point that is not directly radially outward from the old point, cable midsection 16 is displaced angularly in angular displacement sensor 300. Angular displacement sensor 300 detects this angular displacement of cable 12 away from alignment position 305 and produces a signal or signals indicative thereof, such as on lines 308 and 309. Angular displacement sensor 300 will be discussed in greater detail later herein.

Turn servoed motor assembly 120 rotates turn carriage 100 about turn axis θ responsive to the signal from angular displacement sensor 300 indicative of cable displacement about turn axis (θ) so as to move angular displacement sensor 300 toward alignment position 305. As illustrated, turn servoed motor assembly 120 includes a turn servoed motor 122 mounted on turn carriage 100 and a first drive mechanism 125 including a belt 126 connected to first drive wheel 127 connected to drive wheel 111D interacting with inner face 32 of ring 31 of base 30 for rotating turn carriage 100 relative to base 30 and about turn axis θ. As used herein, the term "servoed motor" may apply to any kind of applicable motor actuator such as a servo motor, a stepper motor, or a hydraulic motor for example.

Pitch servoed motor assembly 160 couples pitch carriage 200 to turn carriage 100 for rotating pitch carriage 200 in bearings 135 about pitch axis ϕ responsive to the signal from angular displacement sensor 300 indicative of cable 12 movement about pitch axis ϕ so as to move angular displacement sensor 300 toward alignment position 305. As shown, pitch servoed motor assembly 160 includes a pitch servoed motor 162 mounted on frame 101 and a pitch drive mechanism 165 including a belt 166 connecting first drive wheel 167 with second drive wheel 168 connected to journal shaft 202 of pitch carriage 200 for rotating pitch carriage 200 in bearings 135.

A turn-carriage measuring means 500 measures the rotational position or change of rotational position of turn carriage 100 relative to base 30 and produces a signal, such as on line 510, indicative thereof. Many such measuring means are well-known in the art. In the exemplary embodiment, an optical encoder 520 includes an optical reader 522 mounted on turn carriage 100 for reading an encoder strip 525 on base 30.

A pitch-carriage measuring means 550 measures the rotational position or change of rotational position of pitch carriage 200 relative to turn carriage 100 and produces a signal indicative thereof. Many such measuring means are well-known in the art. In the exemplary embodiment, pitch-carriage measuring means 550 includes an optical encoder 570 including an optical reader 572 mounted on pitch carriage 200 for reading an encoder strip 575 on arc 140 of turn carriage 100 and for producing a signal indicative of the pitch on signal line 560.

In this manner, turn and pitch carriages 100, 200 rotate so as to follow the movement of free end 14 of cable 12 to a new measured point or between an old measured point and a new point until cable midsection 16 is once again in alignment position 305 in angular displacement sensor 300. At this time, the position of the new point or the change in position of the new point relative to the old point can be determined, such as by computer 700 in response to the signals on lines 460, 510, 560 from measuring means 450, 500, and 550.

The measured point's location may be determined from the signals on 460, 510, and 560, for the purpose of reconstructing the measured surface, by mathematical means well known in the art. In the exemplary embodiment, computer 700 interprets the signals on lines 460, 510, and 560 as representing the $\rho$, $\theta$, and $\phi$ components of a point P (not shown) in a polar coordinate system. Because the force of gravity tends to displace the cable midsection 16 downward along a catenary curve, the measured location of cable free end 14 is not coincident with point P, but contains an offset dependent on the cable's extended length, the cable's orientation relative to the force of gravity, the cable's density per unit length, and the cable's tension. Computer 700 determines the offset from these known parameters using mathematical means well-known in the art to determine the measured location of cable free end 14 relative to point P. For increased accuracy, an accelerometer or other level sensor (not shown) may be mounted in base unit 20, such as to pitch carriage 200, for the purpose of determining the cable's precise orientation relative to the force of gravity.

The location signals on distance signal line 460, rotation signal line 510, and pitch signal line 560 are stored in connection with the measured point. This can be done is any desirable manner, such as in a local computer in base unit 20, not shown, or, as in the illustrative example, transmitted, such as by Bluetooth®, to PDA 701.

Signal communication within base unit 30 may be performed in any desirable manner. The exemplary configuration uses wires. Wires are easily used for connectivity because the only relative movement between sending elements and receiving elements is the change in pitch angle $\phi$.

Besides being a measuring device, device 10 may also be an output device. A light pointer, such as laser pointer 270 producing laser beam 271, is attached to pitch frame 201. Using the results of measured data, a computer program, as is well-known in the art, constructs a three-dimensional image of the surfaces. Base unit 20 can be directed, such as by a computer program, to direct light from laser pointer 270 to a given point or along a pattern of points. For example, the outline of an earlier measured wall electrical receptacle can be traced for cutting out of new overlying wallboard or a new pattern for floor tiles may be traced on a floor.

FIGS. 4-8 are views of an illustrative embodiment of an angular displacement sensor 300, such as gimbaled angular displacement sensor 300G, including a biased main gimbal 310 in the form of a plate gimbal.

Figure 4A:
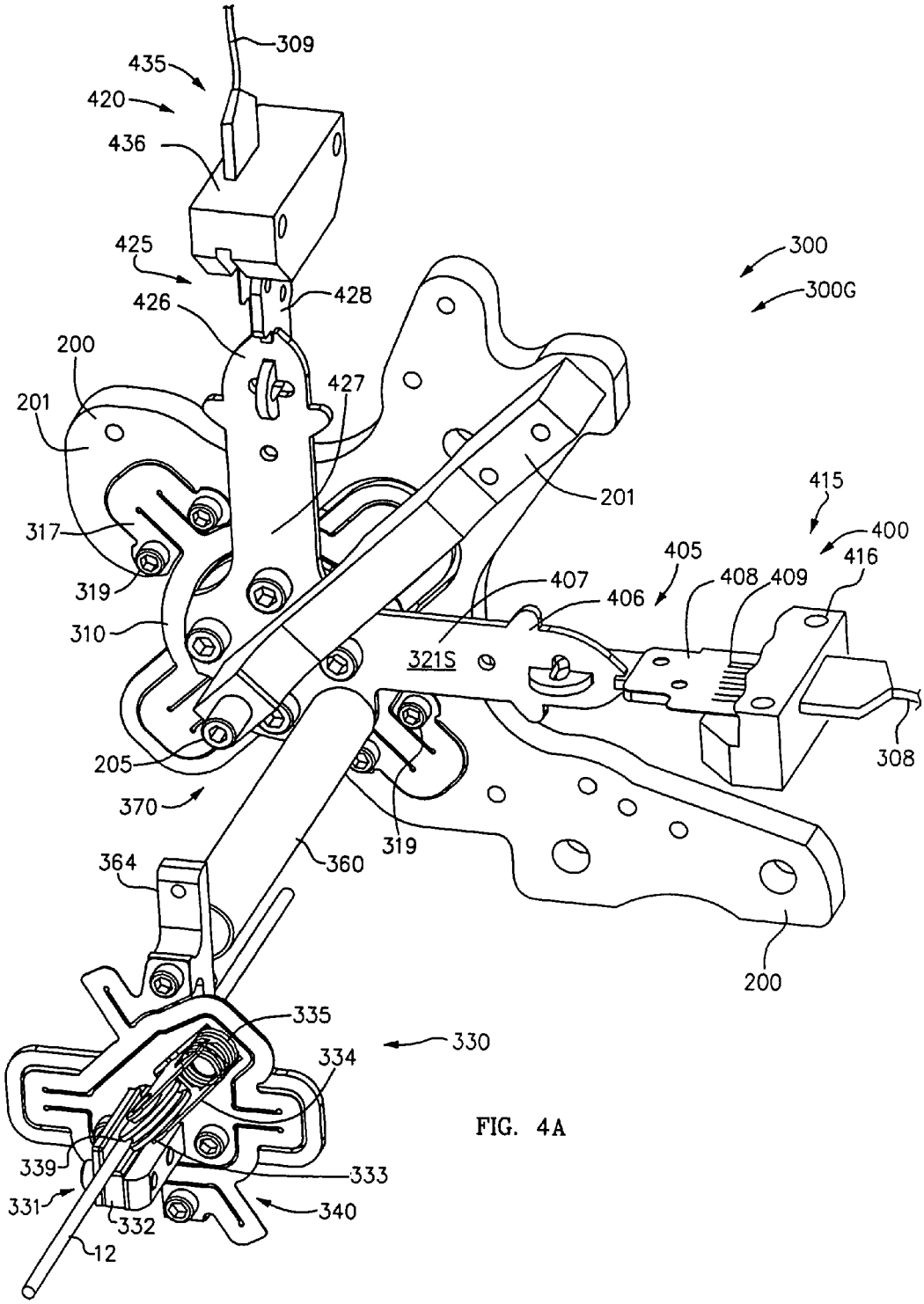
FIG. 4A is a front, top, right side perspective view of the cable angular displacement sensor including a biased main gimbal in the form of a plate gimbal.
Figure 4B:
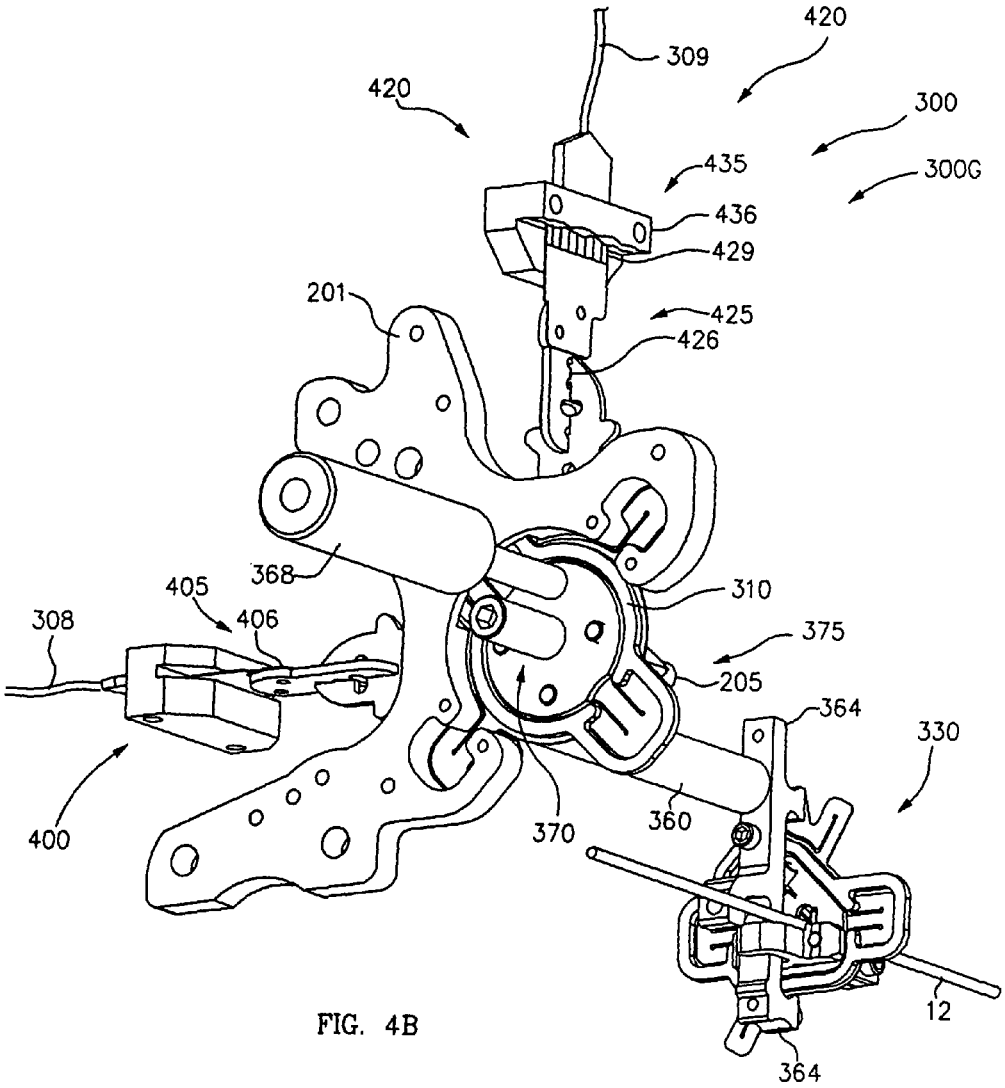
FIG. 4B is a back, bottom, left side perspective view of the cable angular displacement sensor of FIG. 4A.
Figure 5:
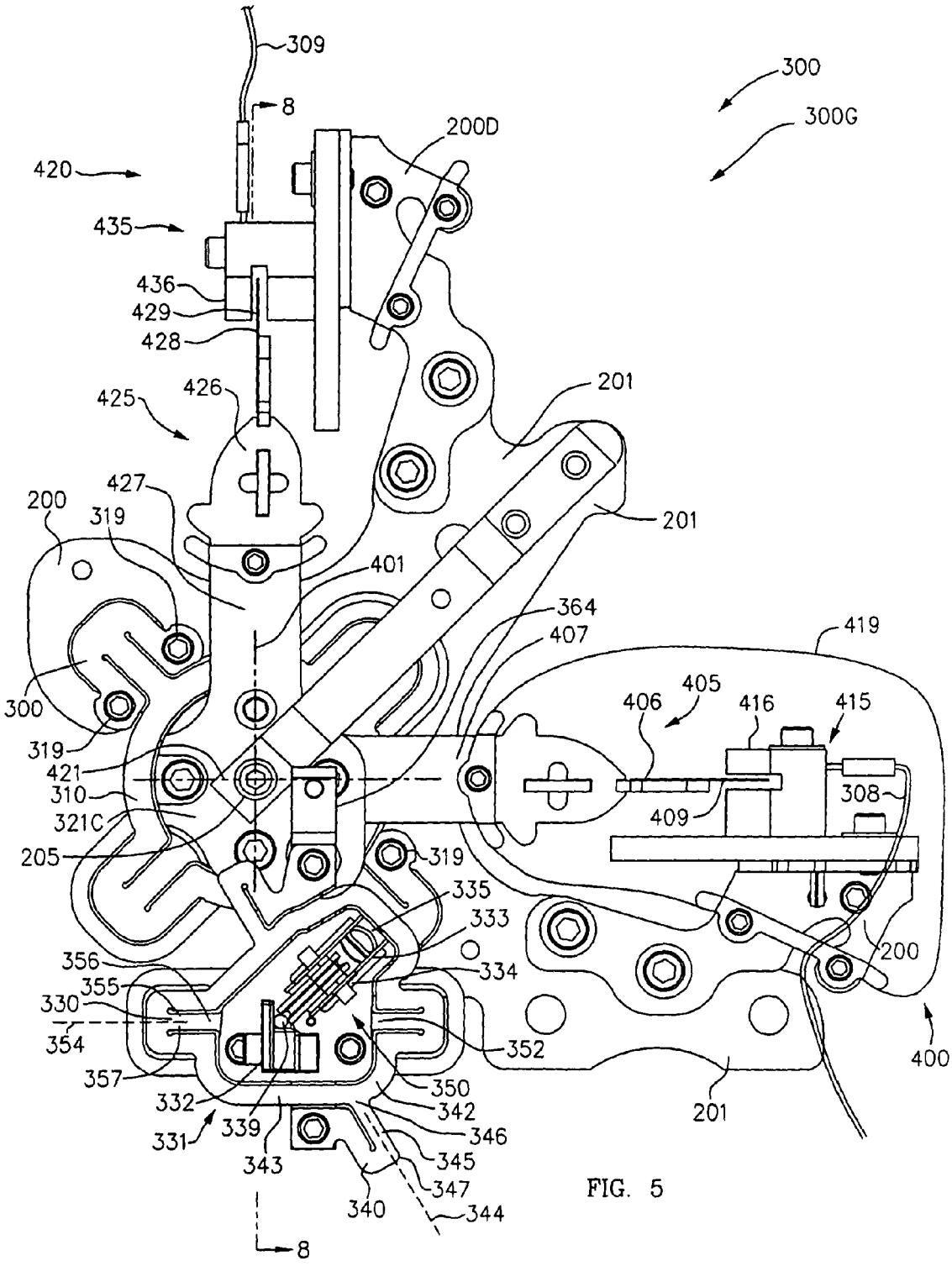
FIG. 5 is a front elevation view of the main angular displacement gimbal of FIG. 4A and FIG. 4B.
Figure 6:
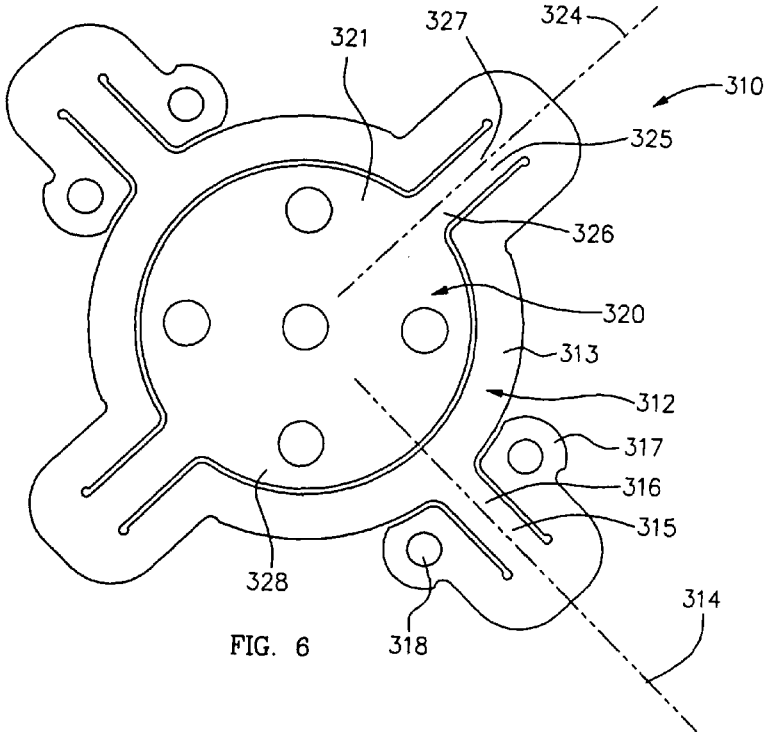
FIG. 6 is an enlarged front elevation view of the plate gimbal of FIG. 5.
Figure 7:
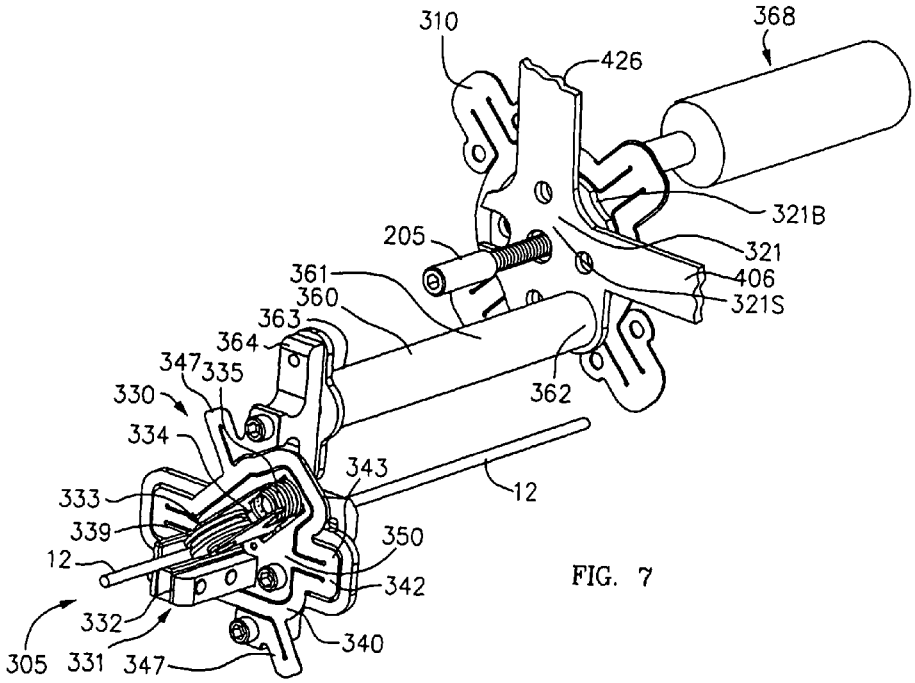
FIG. 7 is an enlarged front, top, right side, perspective of the cable passage assembly of FIGS. 4 and 5.
Figure 8:
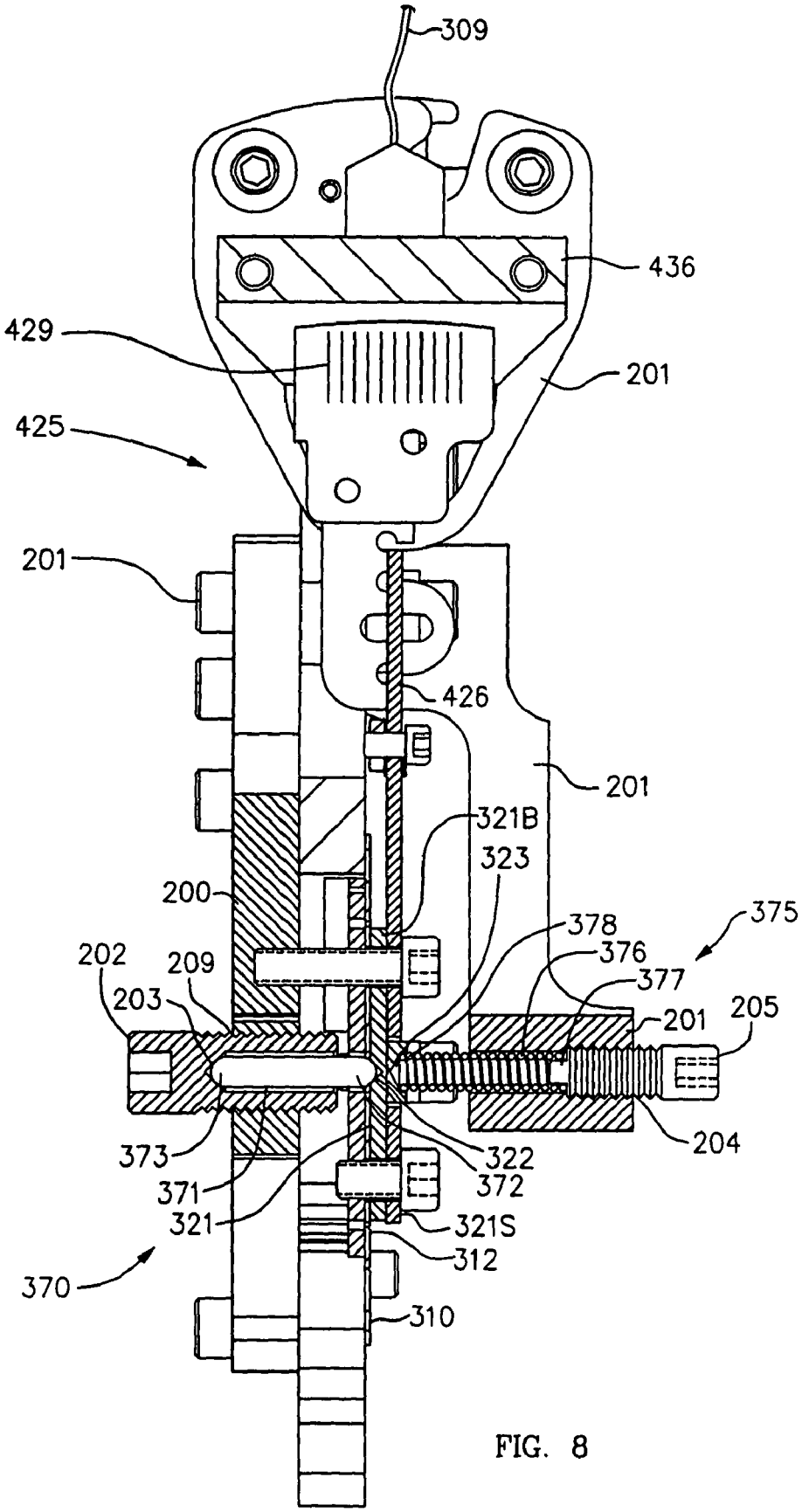
FIG. 8 is an enlarged cross sectional view of the main gimbal thrust bearing assembly.

FIG. 4A is a front, top, right side perspective view of the cable angular displacement sensor 300G including a biased main gimbal 310 in the form of a plate gimbal attached to a portion of pitch-carriage frame 201. FIG. 4B is a back, bottom, left side perspective view of the cable angular displacement sensor 300G of FIG. 4A. FIG. 5 is a front elevation view of the angular displacement sensor 300G of FIG. 4A. FIG. 6 is an enlarged front elevation view of main gimbal 310 of FIGS. 4A and 4B. FIG. 7 is an enlarged front, top, right-side perspective view of the cable passage assembly 330 of FIGS. 4A, 4B and 5. FIG. 8 is an enlarged cross sectional view of main gimbal thrust bearing assembly 370 and biasing assembly 375 of FIG. 5.

Turning for a moment to FIG. 6, there is shown an enlarged front elevation view of main gimbal 310 of FIGS. 4 and 5. Main gimbal 310 is a planar, two axis biased gimbal comprising an outer gimbal 312 and an inner gimbal 320. Outer gimbal 312 includes an outer gimbal ring 313 supported by the inner ends 316 of a pair of outer torsion members 315 on a first gimbal axis 314. Note that "ring" is used due to gimbal tradition, but this element may be any functional shape. Bores 318 receive fasteners 319, such as bolts, as seen in FIGS. 4A and 5, that fasten outer ends 317 of outer torsion members 315 to pitch carriage 200. Inner gimbal 320 includes an inner gimbal ring 321 supported by the inner ends 326 of a pair of inner torsion members 325 on a second gimbal axis 324. Inner torsion members 325 are supported at their outer ends 327 by outer gimbal ring 313. Outer gimbal ring 313 is free to rotate about first gimbal axis 314. Inner gimbal ring 321 is free to rotate about second gimbal axis 324 relative to outer gimbal ring 313 and, thus, may rotate in any direction. Main gimbal 310 is a biased gimbal, in that gimbal rings 313, 321 are biased to rotate to a neutral position when rotational forces are removed. In main gimbal 310, the neutral bias is provided by paired torsion members 315, 325.

Returning to FIGS. 4, 5, 7 and 8, the other main components of angular displacement sensor 300G are a cable passage assembly 330, a gimbal thrust bearing assembly 370, a biasing assembly 375, a first angular displacement sensor 400, and a second angular displacement sensor 420.

FIG. 7 is an enlarged front, top, right side, perspective of the cable passage assembly 330 of FIGS. 4 and 5. Cable passage assembly 330 is mounted on sensor arm plate 321S of inner ring 321 (not seen) of main gimbal 310 and rotates inner ring 321 responsive to angular displacement of cable 12 from cable alignment position 305. An arm 360, such as thin tube 361, has an inner end 362 connected to inner gimbal ring 321 and an outer end 363 including a bracket 364, best seen in FIG. 4B.

An anti-moment gimbal 340, such as a plate gimbal, is mounted on bracket 364. Anti-moment gimbal 340 is a planar, two axis biased gimbal similar to main gimbal 310 and comprises an outer gimbal 342 and an inner gimbal 350. As best seen in FIG. 5, outer gimbal 342 includes an outer gimbal ring 343 supported by the inner ends 346 of a pair of outer torsion members 345 on a first gimbal axis 344. Outer torsion members 345 are supported at their outer ends 347 by bracket 364. Inner gimbal 350 includes an inner gimbal ring 352 supported by the inner ends 356 of a pair of inner torsion members 355 on a second gimbal axis 354. Note that "ring" is used due to gimbal tradition, but this element may be any functional shape. Inner torsion members 355 are supported at their outer ends 357 by outer gimbal ring 343. Outer gimbal ring 343 may rotate about first gimbal axis 344. Inner gimbal ring 352 may rotate about second gimbal axis 354 relative to outer gimbal ring 343 and, thus, may rotate in any direction.

Outer cable passage members 331, including dihedral blocks 332 and a biased pulley 333, define a confined passage 339 for confined passage of midsection 16 of cable 12. Passage members 331 are mounted on inner ring 352 of anti-moment gimbal 340. Pulley 333 is mounted on a swinging yoke 334 and biased toward the cable confining position by a spring 335. This biasing allows pulley 333 to move slightly to allow for passage of protuberances on cable 12. Of course, there are many other manners of accomplishing this confined cable passage 339. For example, instead of dihedral blocks 332, a second pulley could be used, or a plurality of rollers could be used.

Anti-moment gimbal 340 decouples sensor 300G from applying any moment to cable 12 in confined cable passage 339. Anti-moment gimbal 340 may not be necessary for all types of cable 12.

As seen in FIG. 7, a counter mass 368 may be attached to the back side of inner gimbal ring 321 to counter the mass of arm 360 and cable passage assembly 330 so as to balance main gimbal 310 to a more planar neutral position.

As best seen in FIG. 3, Cable 12 is in the alignment position 305 when main datum passage 230, outer cable passage 339, and cable free end 14 are in alignment and main gimbal 310 and anti-moment gimbal 340 are in the neutral position. With cable 12 in alignment position 305, the measurement of a point may be taken. Cable free end 14 is then moved to a new point for measurement. If cable midsection 16 is displaced angularly during movement to the new point, midsection 16 exerts a force against outer cable passage members 331 which, through arm 360, exert a moment on inner gimbal ring 321 of main gimbal 310 so as to rotate it.

FIG. 8 is an enlarged cross sectional view of gimbal thrust bearing assembly 370. Thrust bearing assembly 370 provides a front-to-back pivot point for inner gimbal ring 321 and also may bias or pre-load inner gimbal ring 321 to a position out of the planar position. A pivot rod 371 includes a front end 372 and a back end 373. Inner gimbal ring 321 includes a bearing plate 321B attached to the front of inner gimbal ring 321. Bearing plate 321B includes a rear facing pivot seat 322 and a front facing pivot seat 323. The front end 372 of pivot rod 371 and rear facing pivot seat 322 are adapted such that bearing plate 321B, and hence inner gimbal ring 321, pivots on front end 372. Preferably, also, pivot rod back end 373 and pitch frame 201 are adapted such that pivot rod back end 373 pivots on pitch carriage 200. These functions can be implemented in many manners. In the exemplary embodiment, pivot rod front end 372 is curved, such as being hemispherical. Mounted on or integral with inner gimbal ring 321 and moving therewith are a bearing plate 321B and sensor arm plate 321S. Bearing plate 321B includes a concave conical pivot seat 322 for receiving front end 372 in a pivoting relationship. Pitch frame 201 includes a set screw 202 adjustably threadably engaged in threaded bore 209. Set screw 202 includes a front-facing, concave, conical pivot seat 203 for receiving pivot rod back end 373. Pivot rod back end 373 is curved, such as being hemispherical, for pivoting in seat 203. Note that pivot rod 371 pivots on both ends 372, 373 such that it only can apply an axial force and, other than its own weight, pivot rod 371 cannot apply a side load or moment to main gimbal 310. Pivot rod 371 cannot carry any of the weight of main gimbal 310 or its attachments including anti-moment gimbal 340.

Because main gimbal 310 may exhibit tensional discontinuities at the planar position, set screw 202 is adjusted so that inner gimbal ring 321 is out of planar with the remainder of main gimbal 310.

Means, such as a biasing assembly 375, may be used to further assure that inner gimbal ring 321 is positioned at a particular front-to-rear position against pivot rod 371. To this end, a compression member, such as spring 376, bears against pitch frame 201 and inner gimbal ring 321 to bias inner gimbal ring 321 against pivot rod 371. Spring 376 includes a front end 377 and a back end 378. Pitch frame 201 includes means, such as a set screw 205 adjustably threadably engaged in threaded bore 204, for bearing on spring front end 377 for adjusting the compression biasing of spring 376. Spring back end 378 bears on inner gimbal ring 321, such on bearing plate 321B, such as on front seat 323 thereon. Spring 376 and inner gimbal ring 321 may be adapted (not shown), such as with a hemispherical cap on spring 376 and a concave conical seat on inner gimbal ring 321 for receiving the cap, such that spring 376 pivotly bears against inner gimbal ring 321 so as to impart no moment to inner gimbal ring 321.

Although, the terms "front" and "back" are used to conform to the illustration, thrust bearing assembly 370 can be easily modified to operate in the reverse manner with pivot rod 371 in front of inner gimbal ring 321.

Returning to FIGS. 4 and 5, the movement about a first sensor axis 401 of inner gimbal ring 321 caused by angular displacement of cable 12 is sensed by first angular displacement sensor 400. The movement of inner gimbal ring 321 about a second sensor axis 421 caused by angular displacement of cable 12 is sensed by second angular displacement sensor 420. In the exemplary embodiment, first and second angular displacement sensors 400, 420 are optical encoders as are well known in the art.

First sensor 400 includes a moving portion 405, which rotates with inner gimbal ring 321, and a fixed portion 415 attached to pitch carriage 200. Moving portion 405 includes a radial arm 406 having an inner end 407 connected to sensor arm plate 321S of inner gimbal ring 321 and an outer end 408 having an encoder strip 409 thereon. Arm 406 rotates with inner gimbal ring 321 about first sensor axis 401. Fixed portion 415 includes an encoder read head 416 attached to pitch carriage 200 for reading encoder strip 409. Read head 416 outputs a signal, such as on line 308, indicative of rotation of inner gimbal ring 321 about first sensor axis 401.

Second sensor 420 includes a moving portion 425, which rotates with inner gimbal ring 321, and a fixed portion 435 attached to pitch carriage 200. Moving portion 425 includes a radial arm 426 having an inner end 427 connected to sensor arm plate 321S of inner gimbal ring 321 and an outer end 428 having an encoder strip 429 thereon. Arm 426 rotates with inner gimbal ring 321 about second sensor axis 421. Fixed portion 435 includes an encoder read head 436 attached to pitch carriage 200 for reading encoder strip 429. Read head 436 outputs a signal, such as on line 309, indicative of rotation of inner gimbal ring 321 about the second sensor axis 421.

In the exemplary embodiment, the first sensor axis 401 corresponds to turn axis $\theta$ and second sensor axis 421 corresponds to second axis $\phi$ such that the signal from first sensor 400 may directly be used to control turn servoed motor 122 to rotate turn carriage 100 toward cable alignment position 305 and the signal from second sensor 420 may directly be used to control pitch servoed motor 162 to rotate pitch carriage 200 toward the cable alignment position 305.

If the first and second sensor axes 401, 421 do not correspond to turn axis $\theta$ and second axis $\phi$, then the output signals from sensors 400, 420 are transposed by means well known in the art into corresponding turn axis θ and second axis ϕ rotations before being used to command servoed motors 122, 162 for rotation of turn and pitch carriages 100, 200 toward cable alignment position 305 wherein a measurement of a point may be taken.

As seen in FIG. 5, anti-dust bags, such at anti-dust bag 419, shown in cross-section, covering first displacement sensor 400, may be used to surround sensors to protect them from dust and dirt.

Figure 9:
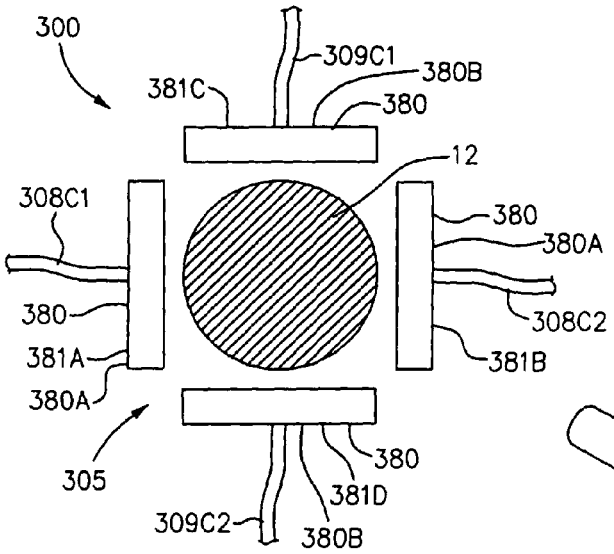
FIG. 9 is a perspective schematic of a second embodiment of the cable angular displacement sensor in the form of contact sensors.

FIG. 9 is a perspective schematic of a second embodiment of the cable angular displacement sensor 300 in the form of proximity or contact sensors, such as contact sensors 380 mounted to frame 201. Cable 12 is shown in alignment position 305.

A first pair 380A of contact sensors 381A, 381B is equally spaced on opposite sides of cable 12 for detecting angular displacement of cable 12 about a first contact sensor axis perpendicular to a midline between first sensors 380A. A second pair 380B of contact sensors 381C, 381D is equally spaced on opposite sides of cable 12 for detecting angular displacement of cable 12 about a second contact sensor axis perpendicular to a midline between second sensors 380B. If cable 12 is angularly displaced so as to touch sensor 381A, sensor 381A produces a signal on line 308C1 indicating rotation is required about the first contact sensor axis in a first direction. If cable 12 touches sensor 381B, sensor 381B produces a signal on line 308C2 indicating rotation is required about the first contact sensor axis in the opposite direction. If cable 12 is angularly displaced so as to touch sensor 381C, sensor 381C produces a signal on line 309C1 indicating rotation is required about the second contact sensor axis in a first direction. If cable 12 touches sensor 381D, sensor 381D produces a signal on line 309C2 indicating rotation is required about the second contact sensor axis in the opposite direction. Depending on the relationship between the first and second contact sensor axes with θ and ϕ, the signals on lines 308C1, 308C2, 309C1 and 309C2 may directly control turn servoed motor 122 or pitch servoed motor 162 or may be transposed by means well known in the art into corresponding turn axis θ and second axis ϕ rotations before being used to command servoed motors 122, 162 for rotation of turn carriage 100 and pitch carriage 200 toward cable alignment position 305 wherein a measurement of a point may be taken.

Because the slight gaps between cable 12 and sensors 381A-381D introduce a slight error, contact sensors 380 are dithered about the sensor axes so that cable 12 is centered in the alignment position 305 before taking a measurement. Servoed motors 122, 162 are controlled to dither contact sensors 380.

Figure 10:
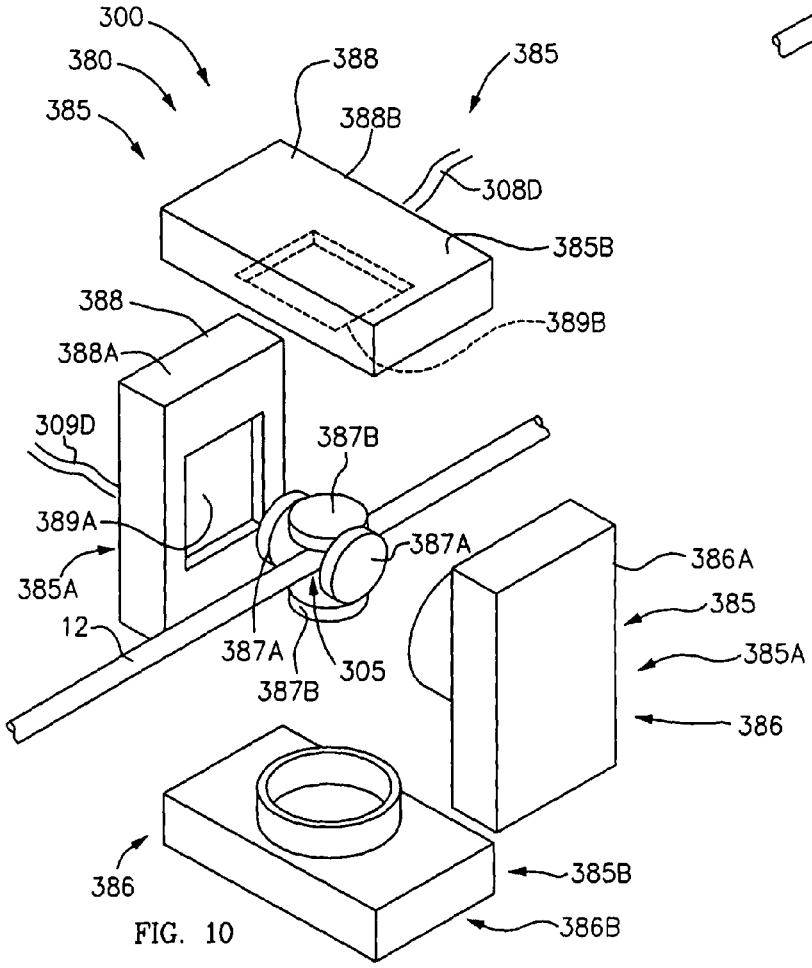
FIG. 10 is a perspective schematic of a third embodiment of the cable angular displacement sensor in the form of optical sensors.

FIG. 10 is a perspective schematic of a third embodiment of the cable angular displacement sensor 300 in the form of optical sensors 385 mounted to frame 201 for detecting movement of cable 12 from the alignment position 305. Cable 12 is shown in alignment position 305.

In the exemplary embodiment, each optical sensor 385 includes a light source 386, some focusing lenses 387, and a light sensor 388.

A pitch optical sensor 385A includes light source 386A that emits light and is disposed on one side of cable 12 and a light sensor 388A for receiving the emitted light is disposed on the other side of cable 12. Light sensor 388A may include a CCD array 389A or other light detector as is well known. One or more lenses, such as lenses 387, may be used to focus or magnify the light for accurate reading. Sensor 388A detects when the shadow of cable 12 moves up or down and produces a signal, such as on line 309D, indicative thereof for directing pitch servoed motor 162 to move pitch carriage 200 so as to return cable 12 to alignment position 305.

A turn optical sensor 385B includes light source 386B that emits light and is disposed on one side of cable 12 and light sensor 388B for receiving the light is disposed on the other side of cable 12. Light sensor 388B may include a CCD array 389B or other light detector as is well known. One or more lenses, such as lenses 387A, may be used to focus or magnify the light for accurate reading. Sensor 388B detects when the shadow of cable 12 moves left or right and produces a signal, such as on line 308D, indicative thereof for directing turn servoed motor 122 to move turn carriage 100 so as to return cable 12 to alignment position 305.

In the exemplary embodiment, the output of optical sensors 385 corresponds directly to movement in θ and ϕ. However, other axes may be used and translated into movement in θ and ϕ.

Other types of optical sensors could be used, such as reflecting light off cable 12 to a light detector.

Figure 11:
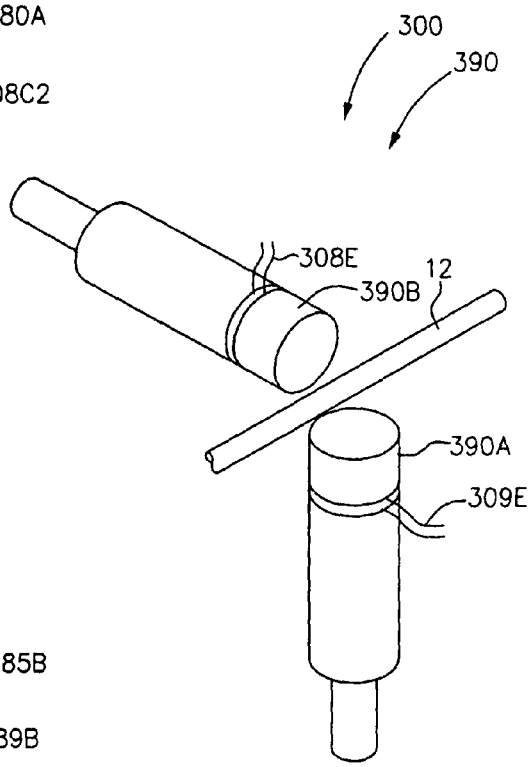
FIG. 11 is a perspective schematic of a fourth embodiment of the cable angular displacement sensor in the form of a magnetic or electromagnetic sensor.

FIG. 11 is a perspective schematic of a fourth embodiment of the cable angular displacement sensor 300 in the form of a magnetic or electromagnetic sensor 390. A pitch electromagnetic sensor 390A detects the proximity of cable 12 and, when cable 12 moves up or down, produces a signal, such as on line 309E, indicative thereof for directing pitch servoed motor 162 to move pitch carriage 200 so as to return cable 12 to alignment position 305. A turn optical sensor 390B detects the proximity of cable 12 and, when 12 moves left or right, and produces a signal, such as on line 308E, indicative thereof for directing turn servoed motor 122 to move turn carriage 100 so as to return cable 12 to alignment position 305.

Magnetic sensors could also be used to detect the proximity of cable. In the exemplary embodiment, the output of sensors 390 corresponds directly to movement in θ and ϕ. However, other axes may be used and translated into movement in θ and ϕ.

Figure 12:
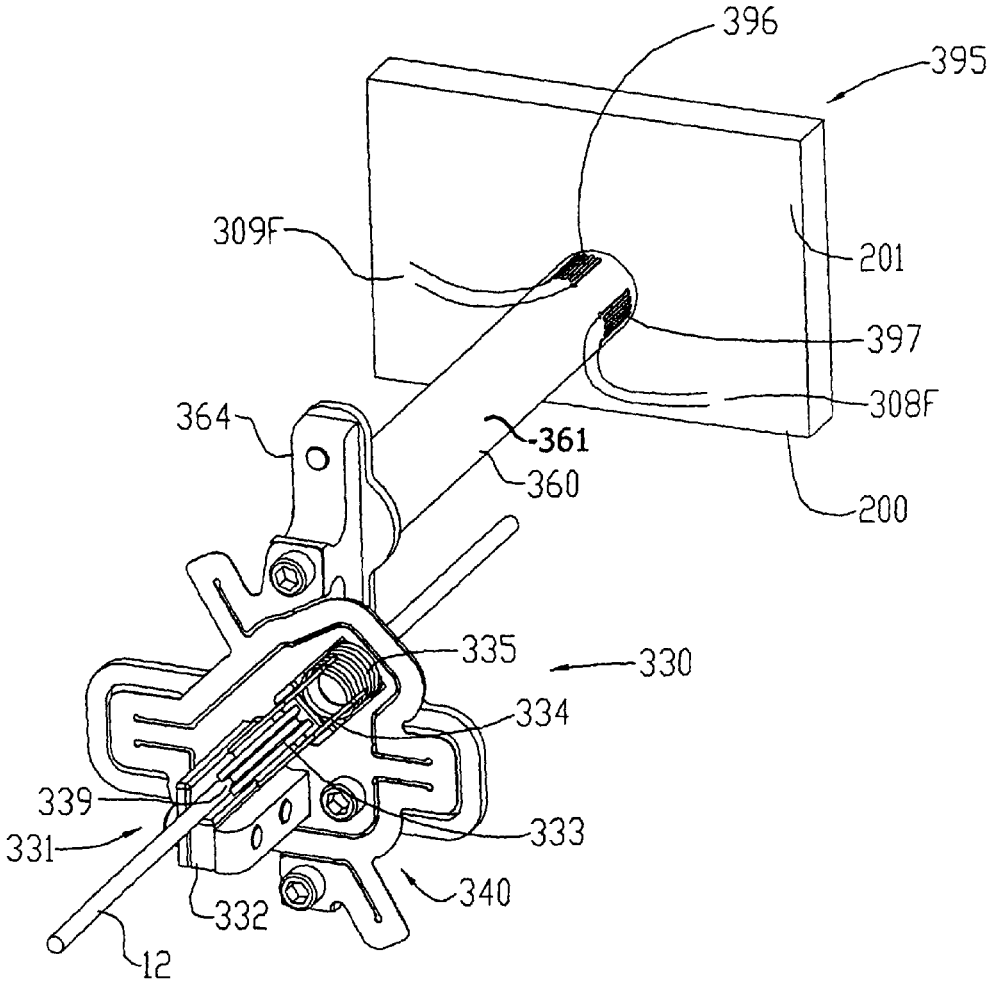
FIG. 12 is a perspective view of a fifth embodiment of the cable angular displacement sensor in the form of a moment sensor.

FIG. 12 is a perspective view of a fifth embodiment of the cable angular displacement sensor 300 in the form of a moment sensor 395. Tube 360 from the anti-moment gimbal from the confined cable passage 339 is solidly attached to frame 201. As discussed elsewhere, other means of producing a confined cable passage 339 such as in FIG. 12 are possible. For example confined passage 339 could be a tube with a close-fitting hole about the outer diameter of cable 12 that the cable 12 passes through, or could be opposing rollers that the cable passes between.

When cable 12 is moved up or down, or to the right or to the left though confined cable passage assembly 330, a force is transmitted through confined cable passage 339, as a moment on arm 360, such as thin tube 361. Arm 360 produces detectable strain on load cells, such as strain gages 396 and 397 mounted on arm 360. Strain gages 396 and 397 produce strain signals which are processed in a manner well known in the art. Other types of load cells known in the art, such as other strain gage arrangements, piezo-resistive-element load cells, hydraulic load cells, pneumatic load cells and optical load cells, may be used. The strain induced on 360 in the vertical axis is detected by strain gage 396 and produces a signal, such as on line 309F, indicative thereof for directing turn servo motor 162 to move pitch carriage 200 so as to return cable 12 to alignment position 305. The strain induced on 360 in the horizontal axis is detected by strain gage 397 and produces a signal, such as on lines 308F, indicative thereof for directing turn servo motor 122 to move carriage 200 so as to return cable 12 to alignment position 305.

Other arrangements of moment-load cell well known in the art may be applied to the mount end of thin tube 360 at the interface with 201.

It should be appreciated that device 10 is versatile and can be used in several modes.

Using device 10 as an output device was discussed above with respect to the laser pointer 270.

Distances longer than the length of cable 12 may be measured by connecting a laser micrometer to the end of cable 12 and holding it, such as by grip 18, such that the emitted laser beam is parallel to cable 12 and the beam lands on the point being measured. The distance indicated by the laser micrometer is added to the cable distance to attain total distance.

Another method of measuring points at longer distances is to attach a laser tape measure to base unit 20. User 90 may be positioned near the point to be measured and use means, such as a PDA with Bluetooth® to drive the turn and pitch servos to place the laser light on the point and take a measurement.

Device 10 can be used to measure artwork or blueprints and then scale up or scale down or even project the measured points on a surface, such as a wall.

Cable 12 is preferably of low and known strain. A wire cable of about one sixteenth inch diameter and having a breaking strength of about 300 pounds has been used. Temperature, humidity, and level sensors may be included to improve accuracy.

From the foregoing description, it is seen that the present invention provides an extremely convenient and accurate cable length measuring device 450.

We claim:

1. A measuring device for measuring the length of a cable under tension moved through said measuring device; said measuring device comprising:
- a frame;
- a measuring pulley rotatably mounted on said frame so as to rotate in a measuring pulley plane about an axis; said measuring pulley having:
  - a circumferential surface including:
    - a cable receiving portion for receiving said cable;
- a rotation sensor connected to said frame for sensing the rotation of said measuring pulley and for producing a signal indicative of the rotation thereof; and
- an anti-slip device for preventing said midsection of said cable from slipping on said cable receiving portion of said measuring pulley comprising:
  - a loading roller comprising:
    - a loading roller shaft mounted on said frame so as to be displaceable relative to said measuring pulley; and
    - a loading roller disk mounted on said loading roller shaft so as to rotate in the measuring pulley plane; and
  - loading assembly including:
    - a tension member flexible in the measuring pulley plane including:
      - a first end connected to said frame;
      - a second end connected to said frame; and
      - a midsection connected to said loading roller shaft for applying loading to said loading roller as a function of the tension of said tension member for pressing said loading roller disk against the cable on said cable receiving portion of said circumferential surface of said measuring pulley such that movement of said cable rotates said measuring pulley.

2. The measuring device of claim 1 wherein:
- said loading assembly further includes:
  - tension adjusting means connected to said frame and to said tension member for adjusting the tension in said tension member.

3. The measuring device of claim 1 wherein:
- said midsection of said tension member supports said loading roller shaft on said frame.

4. The measuring device of claim 3 wherein:
- said loading assembly further includes:
  - tension adjusting means connected to said frame and to said tension member for adjusting the tension in said tension member.

5. A measuring device for measuring the length of a cable under tension moved through said measuring device; said measuring device comprising:
- a frame;
- a measuring pulley rotatably mounted on said frame so as to rotate in a measuring pulley plane about an axis; said measuring pulley having:
  - a circumferential surface including:
    - a cable receiving portion for receiving said cable;
- a rotation sensor connected to said frame for sensing the rotation of said measuring pulley and for producing a signal indicative of the rotation thereof; and
- an anti-slip device for preventing said midsection of said cable from slipping on said cable receiving portion of said measuring pulley comprising:
  - a plurality of loading rollers; each comprising:
    - a loading roller shaft mounted on said frame so as to be displaceable relative to said measuring pulley; and
    - a loading roller disk mounted on said loading roller shaft so as to rotate in the measuring pulley plane; and
  - loading assembly including:
    - a tension member flexible in the measuring pulley plane including:
      - a first end connected to said frame;
      - a second end connected to said frame; and
      - a midsection connected to said loading roller shafts for applying loading to said loading rollers as a function of the tension of said tension member for pressing said loading roller disks against the cable on said cable receiving portion of said circumferential surface of said measuring pulley such that movement of said cable rotates said measuring pulley.

6. The measuring device of claim 5 wherein:
- said loading assembly further includes:
  - tension adjusting means connected to said frame and to said tension member for adjusting the tension in said tension member.

7. The measuring device of claim 5 wherein:
- said midsection of said tension member supports said loading roller shaft on said frame.

8. The measuring device of claim 7 wherein:
- said loading assembly further includes:
  - tension adjusting means connected to said frame and to said tension member for adjusting the tension in said tension member.

9. A cable length measuring device included in a location measuring device including: a cable including a free end for placement by a user at a point to be measured and a midsection; a base unit including: a frame; a main datum passage attached to the frame for confined passage of the midsection of the cable; and means for determining the direction of the cable from the main datum passage to the free end of the cable; said cable length measuring device for measuring the length of the cable under tension moved through said cable length measuring device; said cable length measuring device comprising:

a measuring pulley rotatably mounted on the frame so as to rotate in a measuring pulley plane about an axis; said measuring pulley having:

a circumferential surface including:

a cable receiving portion for receiving the cable;

a rotation sensor connected to said frame for sensing the rotation of said measuring pulley and for producing a signal indicative of the rotation thereof; and an anti-slip device for preventing the midsection of the cable from slipping on said cable receiving portion of said measuring pulley comprising:

a loading roller comprising:

a loading roller shaft mounted on said frame so as to be displaceable relative to said measuring pulley; and a loading roller disk mounted on said loading roller shaft so as to rotate in the measuring pulley plane; and loading assembly including:

a tension member flexible in the measuring pulley plane including:

a first end connected to said frame;

a second end connected to said frame; and a midsection connected to said loading roller shaft for applying loading to said loading roller as a function of the tension of said tension member for pressing said loading roller disk against the cable on said cable receiving portion of said circumferential surface of said measuring pulley such that movement of the cable rotates said measuring pulley.

10. The cable length measuring device of claim 9 wherein:

said loading assembly further includes:

tension adjusting means connected to said frame and to said tension member for adjusting the tension in said tension member.

11. The cable length measuring device of claim 9 wherein:

said midsection of said tension member supports said loading roller shaft on said frame.

12. The cable length measuring device of claim 11 wherein:

said loading assembly further includes:

tension adjusting means connected to said frame and to said tension member for adjusting the tension in said tension member.

* * * * *